US009139396B2

(12) United States Patent
Gamo

(10) Patent No.: US 9,139,396 B2
(45) Date of Patent: Sep. 22, 2015

(54) SHEET PROCESSING APPARATUS AND IMAGE FORMING APPARATUS

(71) Applicant: CANON KABUSHIKI KAISHA, Tokyo (JP)

(72) Inventor: Yohei Gamo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/962,297

(22) Filed: Aug. 8, 2013

(65) Prior Publication Data

US 2014/0061990 A1 Mar. 6, 2014

(30) Foreign Application Priority Data

Aug. 28, 2012 (JP) ..... 2012-187639
Aug. 1, 2013 (JP) ..... 2013-160374

(51) Int. Cl.

| | |
|---|---|
| ***B65H 45/14*** | (2006.01) |
| ***B65H 31/26*** | (2006.01) |
| ***B65H 31/02*** | (2006.01) |
| ***G03G 15/00*** | (2006.01) |
| ***B65H 39/00*** | (2006.01) |
| ***B65H 29/12*** | (2006.01) |
| ***B65H 31/30*** | (2006.01) |
| ***B65H 39/10*** | (2006.01) |

(52) U.S. Cl.

CPC ..... *B65H 39/00* (2013.01); *B65H 29/125* (2013.01); *B65H 31/3027* (2013.01); *B65H 39/10* (2013.01); *B65H 2220/02* (2013.01); *B65H 2301/4213* (2013.01); *B65H 2301/42194* (2013.01); *B65H 2403/942* (2013.01); *B65H 2511/30* (2013.01); *B65H 2801/27* (2013.01)

(58) Field of Classification Search

CPC .. B65H 29/125; B65H 31/3027; B65H 39/00; B65H 2220/02; B65H 2301/4213; B65H 2301/42194

USPC ..... 399/405, 407–410; 270/58.07, 58.08, 270/58.09, 58.14, 58.16; 271/227, 258.01, 271/270

See application file for complete search history.

(56) References Cited

U.S. PATENT DOCUMENTS

| | | | | |
|---|---|---|---|---|
| 8,146,904 | B2 * | 4/2012 | Watanabe et al. | 270/37 |
| 8,613,442 | B2 | 12/2013 | Gamo et al. | |
| 8,752,819 | B2 * | 6/2014 | Sato et al. | 270/58.17 |
| 2004/0188911 | A1 * | 9/2004 | McNamara et al. | 270/58.08 |
| 2006/0214347 | A1 * | 9/2006 | Iizuka et al. | 270/58.14 |
| 2009/0067951 | A1 * | 3/2009 | Yamakawa et al. | 412/37 |
| 2010/0189487 | A1 * | 7/2010 | Iwata | 399/407 |
| 2010/0209164 | A1 * | 8/2010 | Tanaka et al. | 399/407 |
| 2013/0270761 | A1 * | 10/2013 | Kimata | 270/58.08 |
| 2014/0061991 | A1 * | 3/2014 | Shimura et al. | 270/1.01 |

* cited by examiner

FOREIGN PATENT DOCUMENTS

JP 2010-173758 A 8/2010

*Primary Examiner* — Blake A Tankersley
*Assistant Examiner* — Marissa Ferguson Samreth
(74) *Attorney, Agent, or Firm* — Fitzpatrick, Cella, Harper & Scinto

(57) ABSTRACT

First and second buffer roller pairs are driven such that a sheet conveyed sequentially by a conveying roller pair is overlapped with a standby sheet by shifting in a sheet conveying direction and such that the overlapped sheets standby at a branch path. A shift length in overlapping the standby sheet with the conveyed sheet is set such that the more the number of times of drawal into the branch path of the sheet, the shorter the shift length becomes. Thereby, the shift length between the respective sheets turns out to be a predetermined shift length in overlapping the standby sheets with a final conveyed sheet and conveying the sheets to an intermediate processing tray.

13 Claims, 16 Drawing Sheets

SHEET PROCESSING APPARATUS AND IMAGE FORMING APPARATUS

BACKGROUND OF THE INVENTION

1. Field of the Invention

The present invention relates to a sheet processing apparatus configured to implement a process on a sheet, and to an image forming apparatus.

2. Description of the Related Art

Hitherto, some image forming apparatuses, e.g., a copier, a laser printer, a facsimile, and a multi-function copier include a sheet processing apparatus configured to implement various processes such as binding (stapling) and sorting sheets on which image have been formed. One sheet processing apparatus widely used among such sheet processing apparatuses is provided with an intermediate processing tray therein, forms a bundle of sheets (referred to as a 'bundle sheet' hereinafter) by stacking a plurality of sheets on the intermediate processing tray, and implements a binding process on the sheet bundle.

Such sheet processing apparatus requires a certain processing time in implementing the binding process on the sheets. Then, there is a case when the processing time exceeds a sheet discharge interval without completing the binding process within a period from when a final sheet of the sheet bundle to be processed is discharged to the intermediate processing tray until when a next sheet is discharged to the intermediate processing tray, though it also depends on image forming speed of the image forming apparatus that outputs the sheets to the sheet processing apparatus. In such a case, although it is necessary to interrupt an image forming process of a succeeding sheet to complete the binding process of the preceding sheet bundle, productivity of the image forming apparatus drops if the image forming process is interrupted.

Then, Japanese Patent Application Laid-open No. 2010-173758 has disclosed a sheet processing apparatus configured to implement a buffering process of temporarily making several leading sheets of a succeeding sheet bundle stand by during when a binding process is implemented on a preceding sheet bundle on the intermediate processing tray for example. Specifically, this sheet processing apparatus is provided with a branch path branched from a conveying path for conveying a sheet and is configured to make a sheet stand by at the branch path in implementing the buffering process. When the sheet processing apparatus makes a plurality of sheets stand by, the sheet processing apparatus returns the sheet(s) standing by in the branch path from the branch path to the conveying path concurrently with a succeeding sheet to be conveyed and makes those overlapped sheets stand by at the branch path.

By the way, the image forming speed of the image forming apparatus is increasing year by year. Therefore, it is required to increase a number of sheets to be overlapped in the buffering process to assure a time for the binding process in the buffering process. However, if the number of sheets to be overlapped increases, a number of times when the sheets move in and out of the branch path described above also increases. Here, because the sheet receives conveyance resistance from the branch path in moving in and out of the branch path, a shift length between the overlapped sheets increases from a predetermined shift length corresponding to an increase of the number of times of the move of the sheets that move in and out of the branch path. The conveyance resistance is considered to be caused by sliding friction of the sheet that slides along a conveying guide for example, and the shift length between the overlapped sheets increases by the sliding friction of the sheets that slide along a stationary guide of the branch path. Accordingly, the more the number of times of the move of the sheets that move in and out of the branch path, the more the shift length between the sheets increases proportionally with a number of times of receiving the sliding friction caused with the stationary guide. That is, a sheet overlapped preceding to a finally overlapped sheet among the overlapped sheets including the finally overlapped sheet and the previously overlapped sheet, receives an influence of the sliding friction caused with the stationary guide by one time more than that received by the final sheet, and the more the sheet is previously overlapped, the more the shift length from the sheet overlapped thereafter increases.

Due to that, if the number of sheets to be overlapped increases, the sheet processing apparatus described above has a possibility of increasing the shift length between the sheets, of increasing a sheet overlapping length more than a predetermined sheet overlapping length preset to be able to align the sheets in discharging to the processing tray, and of thus causing misalignment.

SUMMARY OF THE INVENTION

According to first aspect of the present invention, a sheet processing apparatus includes a sheet stacking portion configured to stack a sheet to be processed, a first sheet conveying portion configured to convey the sheet toward the sheet stacking portion, a standby portion branched from a sheet conveying path between the sheet stacking portion and the first sheet conveying portion and makes a sheet to be processed next stand by during a sheet bundle on the sheet stacking portion being processed, a second sheet conveying portion provided along the sheet conveying path between the sheet stacking portion and the standby portion, configured to be able to rotate in normal and reverse directions, and conveying the sheet to the standby portion by rotating in the reverse direction, a third sheet conveying portion provided in the standby portion so as to be able to rotate in normal and reverse directions, drawing the sheet conveyed to the standby portion by the second sheet conveying portion into the standby portion by rotating in the reverse direction to make the sheet stand by, and drawing the standby sheet out of the standby portion by rotating in the normal direction, and a control portion that drives the second and third sheet conveying portions such that the sheet conveyed sequentially by the first sheet conveying portion overlaps sequentially with the standby sheet drawn out of the standby portion while shifting by a shift length with respect to the standby sheet just preceding to the sheet conveyed by the first sheet conveying portion in a sheet conveying direction and such that the overlapped sheets are conveyed to and made stand by at the standby portion, the control portion setting the shift length to be less in proportion to a number of times of drawal into the standby portion of the overlapped standby sheet during the sheet bundle on the sheet stacking portion being processed.

According to second aspect of the present invention, a sheet processing apparatus includes a sheet stacking portion configured to stack a sheet to be processed, a first sheet conveying portion configured to convey the sheet toward the sheet stacking portion, a standby portion branched from a sheet conveying path between the sheet stacking portion and the first sheet conveying portion and makes a sheet to be processed next stand by during a sheet bundle on the sheet stacking portion being processed, a second sheet conveying portion that conveys the sheet to the standby portion, a control portion that drives the second sheet conveying portion such that a sheet conveyed sequentially by the first sheet conveying portion overlaps sequentially with an overlapped standby sheet standing by just preceding to the sheet conveyed by the first sheet conveying portion while shifting in a sheet conveying direction and such that the overlapped sheets are conveyed to and made stand by at the standby portion, the control portion setting a shift length in overlapping the sheets such that the shift length meets a condition X−(N−n−1)×x, where 'N' represents a number of sheets to be finally overlapped, 'n' a number of sheets standing by at the standby portion, 'x' a length shifting in one overlapping operation, and 'X' a target shift length in overlapping a final sheet.

Further features of the present invention will become apparent from the following description of exemplary embodiments with reference to the attached drawings.

DESCRIPTION OF THE EMBODIMENTS

First Embodiment

<Overall Configuration of Image Forming Apparatus>

Figure 1:
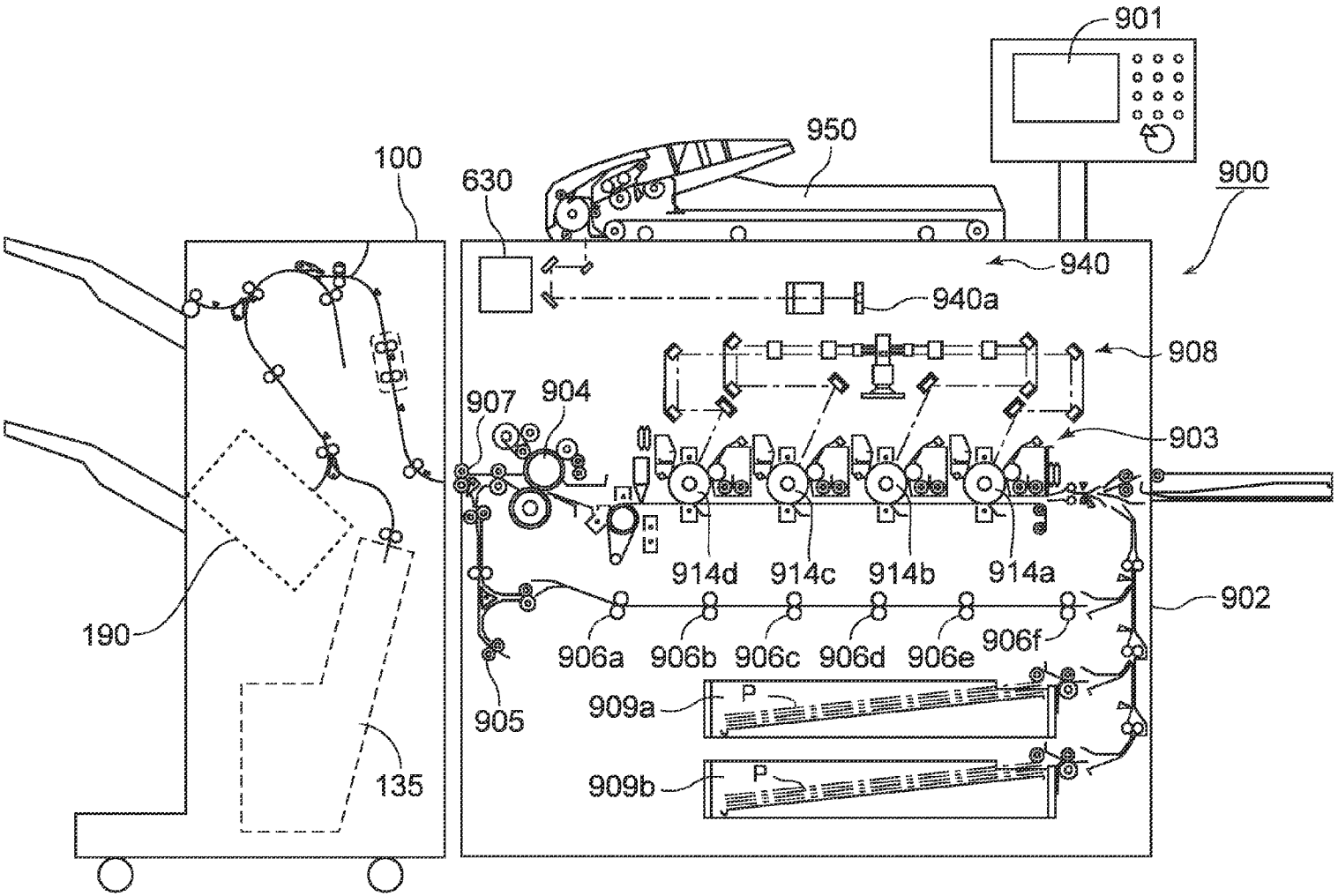
FIG. 1 is a schematic diagram showing an overall configuration of a color copier which is one exemplary image forming apparatus including a sheet processing apparatus of a first embodiment.

A first embodiment of the present invention will be described below in detail with reference to the drawings. FIG. 1 is a schematic diagram showing an overall configuration of a color copier including a sheet processing apparatus of the first embodiment. As shown in FIG. 1, the color copier 900, i.e., one exemplary image forming apparatus, includes a body of the color copier (referred to as a 'copier body' hereinafter) 902, a document reading portion (image reader) 940 provided at an upper part of the copier body 902, and a document feeder 950 configured to feed documents sequentially to the document reading portion 940 for automatically reading the documents.

The copier body 902 includes a sheet feeding cassettes 909*a* and 909*b* that stack normal sheets P on which images are formed, an image forming portion 903 configured to form toner images on the sheet by using electro-photographic processes, a fixing portion 904 configured to fix the toner image formed on the sheet, and others. The color copier 900 also includes a manipulating portion 901 which is provided on an upper surface of the copier body 902 and through which a user of the copier operates the copier body 902 by inputting/setting variously, and a finisher 100, i.e., a sheet processing apparatus, connected to a side of the copier body 902. The color copier 900 also includes a CPU circuit portion 630 that controls the copier body 902 and the finisher 100 within the copier body 902.

An image sensor 940*a* provided in the document reading portion 940 reads an image of a document conveyed by the document feeder 950 at first in forming the image of the document on a sheet in the color copier 900 configured as described above. Then, digital data read by the sensor 940*a* is input to an exposure portion 908, and the exposure portion 908 irradiates light corresponding to the digital data to photoconductive drums 914 (914*a* through 914*d*) provided in the image forming portion 903. In response to the irradiation of the light, an electrostatic latent image is formed on a surface of the photoconductive drum. Each color toner image of yellow, magenta, cyan and black is formed on the surface of the photoconductive drum by developing the electrostatic latent image.

Next, these four color toner images are transferred on the sheet fed from the sheet feeding cassette 909*a* or 909*b*, and the toner images transferred on the sheet are fixed by the fixing portion 904. If a printing mode is a mode of forming an image on one surface of the sheet, the sheet on which the toner images have been fixed is discharged from a discharge roller pair 907 to the finisher 100 connected on the side of the copier body 902.

If the printing mode is a mode of forming images on both surfaces of the sheet, the sheet is passed from the fixing portion 904 to a reversing roller 905 and then the reversing roller 905 is reversely rotated with predetermined timing to convey the sheet in a direction of double face conveying rollers 906*a* through 906*f*. Then, the sheet is conveyed to the image forming portion 903 again to transfer four color toner images of yellow, magenta, cyan and black on a back surface of the sheet. The sheet in which the four color toner images have been transferred on the back surface thereof is conveyed to the fixing portion 904 again to fix the toner images and is then discharged from the discharge roller pair 907 to the finisher 100.

<Overall Structure of Finisher>

The finisher 100 is configured to sequentially take in the sheet discharged out of the copier body 902, to align and to bundle a plurality of taken-in sheets as one bundle, and to implement such processes as stapling (binding), book-binding, and others. The finisher 100 is provided with a stapling portion 190, i.e., a binding portion, configured to staple a sheet bundle, and a saddle unit 135 configured to bind a book by two-folding the sheet bundle.

Figure 2:
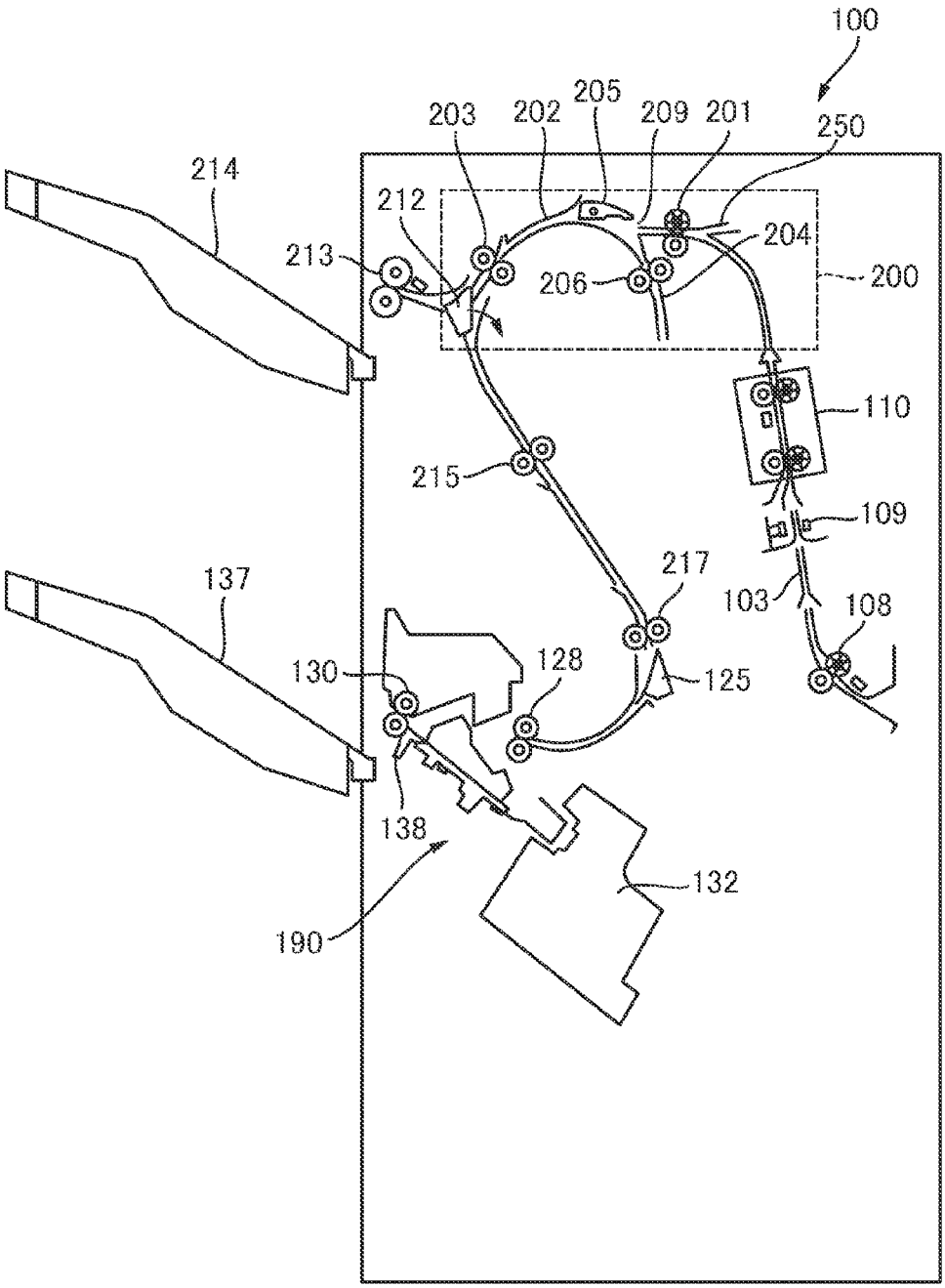
FIG. 2 is a schematic diagram illustrating a configuration of the sheet processing apparatus, i.e., a finisher.

As shown in FIG. 2, the finisher 100 includes an inlet roller pair 108 configured to take a sheet into the apparatus. That is, the sheet discharged out of the copier body 902 is passed to the inlet roller pair 108. It is noted that an inlet sensor not shown simultaneously detects the sheet passing timing at this time.

Then, during when the sheet conveyed from the inlet roller pair 108 passes through a conveying path 103, a transverse registration detecting sensor 109 detects position of an end portion of the sheet and detects how much a center position of the sheet deviates in a width direction with respect to center position of a sheet conveying path of the finisher 100. When such deviation in the width direction (referred to as a 'transverse registration error' hereinafter) is detected, a shift operation of moving a shift unit 110 in a front or back direction by a predetermined distance is carried out to correct the transverse registration error of the sheet. It is noted that the term 'front' refers to a front side of the apparatus when the user faces to the manipulating portion 901 shown in FIG. 1, and the term 'back' refers to a back side of the apparatus in the present embodiment.

Next, the sheet is conveyed to the conveying roller pair 201 and reaches the first buffer roller pair 203 by passing through a conveying path 202 between an intermediate processing tray 138 and the conveying roller pair 201. When the sheet is to be discharged to an upper tray 214 after that, an upper path switching member 212 is turned in a direction of an arrow by a drive portion such as a solenoid not shown. With this arrangement, the sheet conveyed by the first buffer roller pair 203 is discharged to the upper tray 214 by an upper discharge roller 213.

When the sheet is to be discharged to a lower stacking tray 137, the sheet conveyed by the first buffer roller pair 203 is guided by the upper path switching member 212 toward the intermediate processing tray 138, and is conveyed to the intermediate processing tray 138 sequentially by conveying rollers 215 and 217 and an under discharge roller pair 128. Then, the sheets thus conveyed to the intermediate processing tray 138 are aligned to be a sheet bundle on the intermediate processing tray 138 by a return portion described later.

Next, the sheet bundle thus aligned on the intermediate processing tray 138 is stapled as necessary by a stapler 132 that composes a binding portion, and is then discharged to the lower stacking tray 137 by a bundle discharge roller pair 130. It is noted that when the finisher 100 is attached with an inserter not shown, a sheet is supplied from the inserter to the finisher 100 through a sheet conveying path 250. The stapler 132, i.e., the binding portion, is movable in a width direction orthogonal to the sheet conveying direction (referred to as a 'depth direction' hereinafter) and is capable of stapling a plurality of spots of a rear end portion, i.e., an upper end portion in the sheet conveying direction (one end portion in the sheet conveying direction), of the sheet bundle. Meanwhile, when a saddle stitch processing of the sheet is to be carried out, a saddle pass switching member 125 is switched by a drive portion such as a solenoid not shown to feed the sheet toward the saddle unit 135 (see FIG. 1). Thus, the stapler 132 and the saddle unit 135 compose a processing portion of the finisher 100 that implements the abovementioned processes on the sheets.

<Configuration around Stapling Portion>

Figure 3:
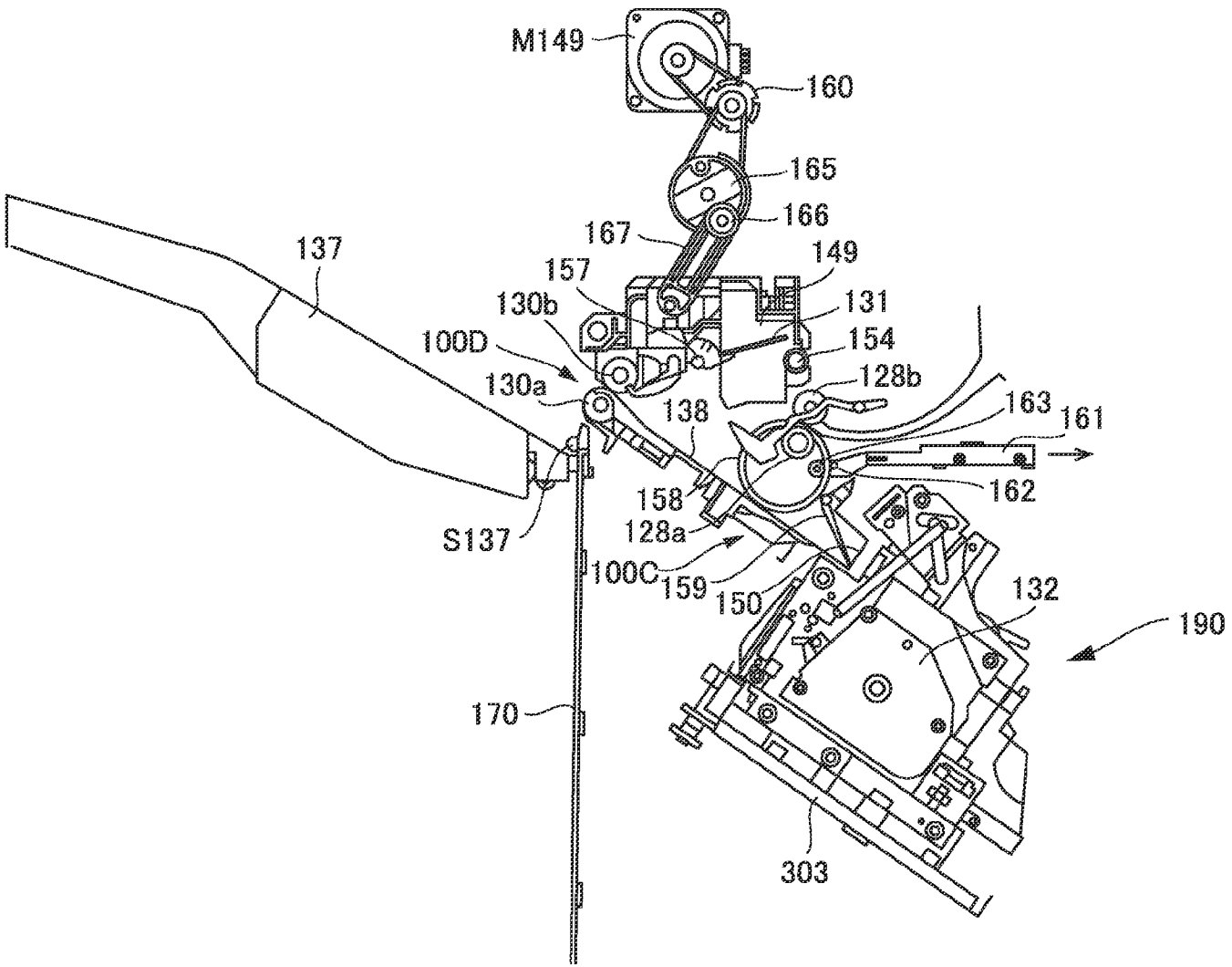
FIG. 3 is a schematic diagram illustrating a configuration of a stapling portion provided in the finisher.

Next, a configuration around a stapling portion 190 including the intermediate processing tray 138 will be explained. As shown in FIG. 3, the intermediate processing tray 138 is disposed aslant such that a downstream side (left side in FIG. 3) in the sheet conveying direction of the sheet bundle is located above and an upstream side (right side in FIG. 3) is located down, and is provided with a rear end stopper 150 disposed at a downward end at the upstream side of the intermediate processing tray 138. It is noted that the intermediate processing tray 138 may be disposed horizontally.

Figure 4:
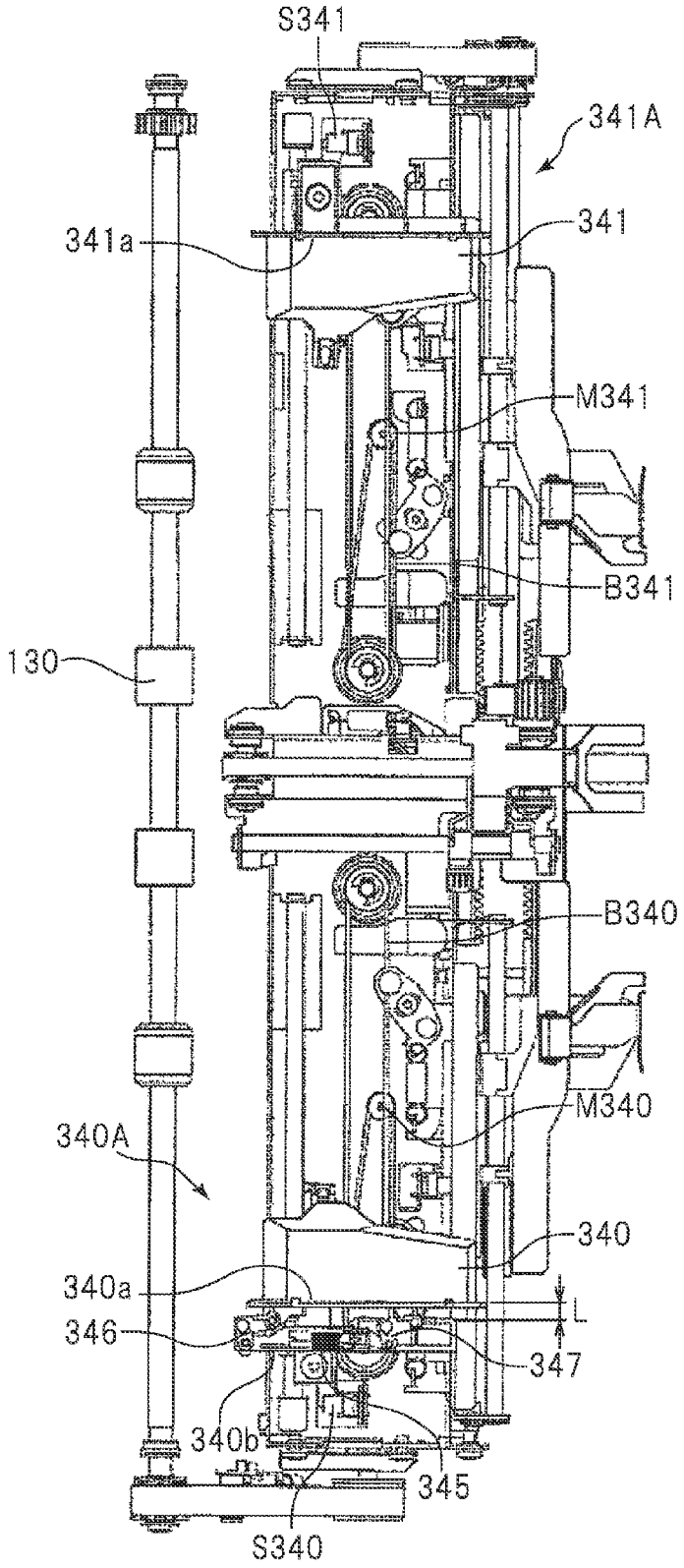
FIG. 4 is a schematic diagram illustrating a configuration of a side edge restricting portion provided in the stapling portion.

The intermediate processing tray 138 is provided with front and back alignment portions 340A and 341A as shown in FIG. 4 at an intermediate part thereof. The front and back alignment portions 340A and 341A compose a widthwise alignment portion (side edge restricting portions) that restricts (aligns) both side edge positions in the width direction of the sheet conveyed to the intermediate processing tray 138. Here, the front and back alignment portions 340A and 341A include front and back aligning plates 340 and 341 respectively having aligning portions 340*a* and 341*a* that compose the aligning surfaces, respectively, and front and back aligning plate motors M340 and M341 that independently drive the front and back aligning plates 340 and 341, respectively.

Then, the front and back aligning plates 340 and 341 are driven by front and back aligning plate motors M340 and M341 through an intermediary of timing belts B340 and B341 that compose a drive portion together with the front and back aligning plate motors M 340 and M341 in restricting the both side edge position of the sheet. With this arrangement, the front and back aligning plates 340 and 341 that freely come into contact with the sheet move independently of the intermediate processing tray 138 along the width direction and align the sheet by abutting with the both side edges of the sheet stacked on the intermediate processing tray 138.

That is, the front and back aligning plates 340 and 341 are disposed so that the respective aligning portions (aligning surfaces) 340*a* and 341*a* face with each other on the intermediate processing tray 138 and are assembled so as to be movable in an aligning direction. As a result, it is possible to align the positions of the sheet on the intermediate processing tray 138 by the front and back aligning plates 340 and 341 even when a sheet (or a sheet bundle) comes to be conveyed while shifting in the width direction.

One aligning plate, e.g., the front aligning plate 340, is arranged such that a tensile spring 345 is provided between the aligning portion 340*a* composing the aligning surface of the front aligning plate 340 and a body 340*b* of the aligning plate 340 so that the aligning portion 340*a* projects toward the sheet side by a predetermined length L by the tensile spring 345 and moving links 346 and 347. With this arrangement, the aligning portion 340*a*, i.e., a pressure contact portion, moves toward the body side against the tensile spring 345 when the aligning portion 340*a* comes in pressure contact with the sheet in restricting the side edge position of the sheet. It is noted that the aligning plates 340 and 341 are provided with sensors S340 and 5341 that detect home positions of the aligning plates 340 and 341 to control positions of the aligning plates 340 and 341 by their own motors and sensors.

As shown in FIG. 3, the intermediate processing tray 138 is also provided with a draw-in puddle 131 composed of a plurality of puddles, and an openable guide 149 above the downstream side of the sheet conveying direction (upstream side in an intake direction) thereof. The draw-in puddle 131 is disposed above the intermediate processing tray 138 and whose plurality of puddles are fixed along a drive shaft 157 that is rotated by a paddle driving motor not shown. The draw-in puddle is arranged such that the puddles rotate counterclockwise in FIG. 3 with adequate timing by the puddle driving motor.

As shown in FIG. 3, the intermediate processing tray 138 is also provided with a sheet rear end aligning portion 100C, i.e., a conveying direction aligning portion that aligns position of the sheet in the conveying direction, and a discharge port 100D. The sheet rear end aligning portion 100C includes the draw-in puddle 131, a belt roller 158, a rear end lever 159, and the rear end stopper 150 that abuts with (receives) the conveying direction upstream end of the sheet. Then, the conveying direction upstream end of the sheet conveyed on the intermediate processing tray 138 abuts against the rear end stopper 150 by being guided to the rear end lever 159 by the counterclockwise rotations of the draw-in paddle 131 and the belt roller 158 described above. Thereby, the conveying direction position of the sheet is aligned.

Here, the belt roller 158, i.e., an endless belt, is provided above the intermediate processing tray 138 liftably (movably up and down) and is wrapped around an outer circumference of a first discharge roller 128*a* that compose a lower discharge roller pair 128. The belt roller 158 is also pinched by pinch rollers A162 and B163 provided at a distal end of a belt moving member 161.

In the manner thus pinched by the pinch rollers A162 and B163, the belt roller 158 rotates counterclockwise following rotation of the first discharge roller 128*a* in such a positional relationship that a lower part thereof is in contact with an uppermost sheet stacked on the intermediate processing tray 138. With this arrangement, the sheet conveyed on the intermediate processing tray 138 is conveyed in an opposite direction from the conveying direction, and the upstream side end in the sheet conveying direction which is one end in the sheet conveying direction of the sheet abuts against the rear end stopper 150. The belt roller 158 is also arranged such that its shape can be elastically changed and the position where the belt roller 158 comes in contact with the uppermost sheet can be moved up and down by moving the belt moving member 161 in a direction of an arrow in FIG. 3.

As shown also in FIG. 3, the openable guide 149 is supported turnably centering on a supporting shaft 154 and is disposed as an upper conveying guide facing the intermediate processing tray 138. The openable guide 149 turnably holds an upper bundle discharge roller 130*b* that composes a bundle discharge roller pair 130 together with a lower bundle discharge roller 130*a* provided at the downstream side end of the intermediate processing tray 138.

The upper bundle discharge roller 130*b* is arranged such that it comes into contact with or separates from the lower bundle discharge roller 130*a* in response to oscillation of the openable guide 149 that holds the upper bundle discharge roller 130*b*. It is noted that the openable guide 149 normally oscillates upward when the sheet is conveyed on the intermediate processing tray 138 and in response to that, the upper bundle discharge roller 130*b* separates from the lower bundle discharge roller 130*a*, i.e., the other roller of the bundle discharge roller pair 130, thus opening the bundle discharge roller pair 130. With this arrangement, the sheet conveyed from the lower discharge roller pair 128 slides down on a stacking surface of the intermediate processing tray 138 or on a sheet stacked on the intermediate processing tray 138 due to the inclination of the intermediate processing tray 138 and the action of the draw-in paddle 131.

In response to an end of the sheet processing on the intermediate processing tray 138, the openable guide 149 oscillates downward as an opening motor M149 rotates, and pinches a sheet bundle by the upper and lower bundle discharge rollers 130*b* and 130*a*. It is noted that the bundle discharge roller pair 130, e.g., the lower bundle discharge roller 130*a*, is configured to be able to rotate in normal and reverse directions by a bundle discharge driving motor not shown.

The sheet bundle is discharged out of the discharge port 100D to the lower stacking tray 137 by the bundle discharge roller pair 130 that rotates in the condition in which the sheet bundle is pinched by the upper and lower bundle discharge rollers 130*b* and 130*a*. Here, the stacking tray 137 is inclined such that a downstream side in the discharge direction thereof is higher than an upstream side. Due to that, when the sheet bundle is discharged to the stacking tray 137, an upstream end in the discharge direction of the sheet bundle abuts against a stacking wall 170, i.e., a restricting member, provided below the discharge port 100D by the inclination of the lower stacking tray 137 and thereby the upstream end position in the discharge direction of the sheet bundle is restricted.

<Configuration of Control Portion>

Figure 5:
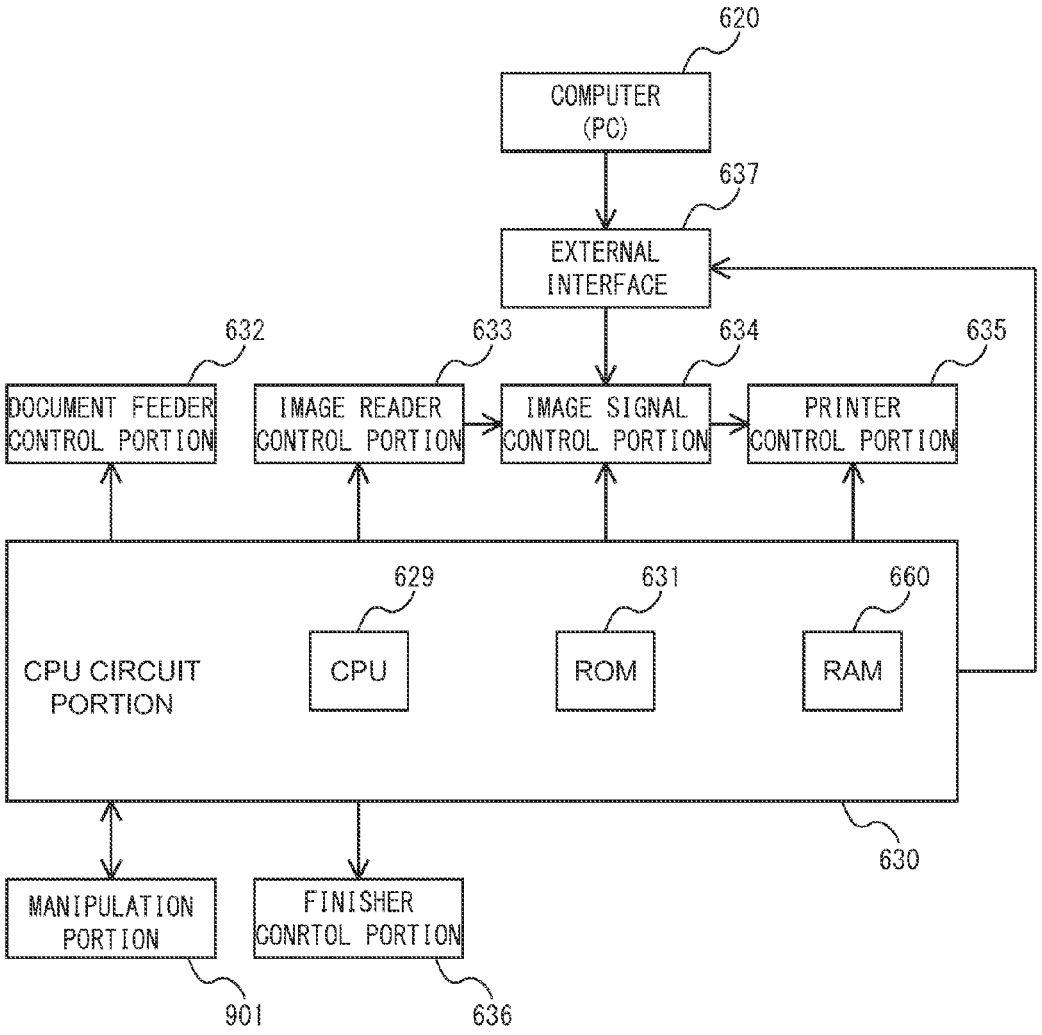
FIG. 5 is a control block diagram of the color copier.

FIG. 5 is a control block diagram of the color copier 900. A CPU circuit portion 630 includes a CPU 629, a ROM 631 storing a control program and others, a RAM 660 used as an area for temporarily holding control data and as a working area of calculations accompanying with controls. In FIG. 5, the color copier 900 further includes an external interface 637 that connects the color copier 900 with an external PC (personal computer) 620. Receiving print data from the external PC 620, the external interface 637 develops this data into bit map images and outputs them as image data to an image signal control portion 634.

Then, the image signal control portion 634 outputs this data to a printer control portion 635, and the printer control portion 635 outputs the data from the image signal control portion 634 to an exposure control portion not shown. It is noted that an image data of a document read by an image sensor 940*a* (see FIG. 1) is output from an image reader control portion 633 to the image signal control portion 634, and the image signal control portion 634 outputs this image output to the printer control portion 635.

A manipulating portion 901 includes a plurality of keys for setting various functions related to the image forming process, a display portion for displaying preset conditions, and others. The manipulating portion 901 configured to output a key signal corresponding to each key manipulated by the user to the CPU circuit portion 630 and to display corresponding information based on the signal from the CPU circuit portion 630 on the display portion.

Following the control program stored in the ROM 631 and the setting of the manipulating portion 901, the CPU circuit portion 630 controls the image signal control portion 634 and the document feeder 950 (see FIG. 1) through a document feeder control portion 632. The CPU circuit portion 630 also controls the document reading portion 940 (see FIG. 1) through the image reader control portion 633, controls the image forming portion 903 (see FIG. 1) through the printer control portion 635, and controls the finisher 100 through the finisher control portion 636, respectively.

It is noted that the finisher control portion 636 is mounted in the finisher 100 and drives and controls the finisher 100 by exchanging information with the CPU circuit portion 630 in the present embodiment. This CPU circuit portion 630 and the finisher control portion 636 compose a control portion that controls the finisher 100. It is noted that it is also possible to dispose the finisher control portion 636 integrally with the CPU circuit portion 630 within the copier body and to control the finisher 100 directly from the copier body.

Figure 6:
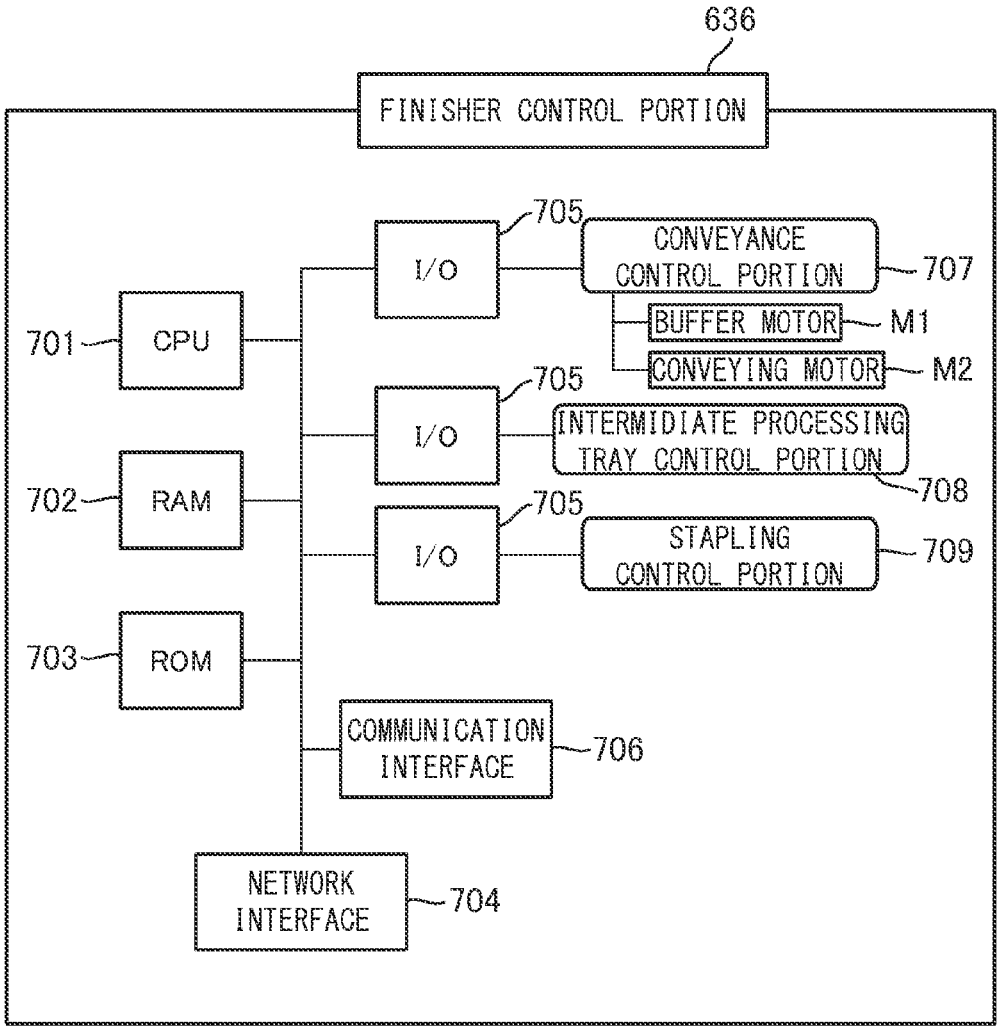
FIG. 6 is a control block diagram of the finisher.

FIG. 6 is a control block diagram of the finisher 100 of the present embodiment. The finisher control portion 636 is composed of a CPU (microcomputer) 701, a RAM 702, a ROM 703, input/output portions (I/O) 705, a communication interface 706, a network interface 704, and others. The finisher control portion 636 also includes a conveyance control portion 707, an intermediate processing tray control portion 708, and a stapling control portion 709 respectively connected to the input/output portions 705.

Here, the conveyance control portion 707 controls a sheet transverse registration detecting process, a sheet buffering process, and a conveying process. The conveyance control portion 707 is connected with a buffer motor M1, i.e., a drive portion, that drives a second buffer roller pair 206 in normal and reverse directions as described later, a conveying motor M2, i.e., a drive portion, that drives a conveying roller pair 201, and others. The conveyance control portion 707 controls timing for reversing the buffer motor M1 based on a signal detected by a conveyance sensor 235 for example, and controls a sheet conveyance starting timing of the second buffer roller pair 206. The intermediate processing tray control portion 708 controls the operation of the front and back aligning plates described above, the operation of the draw-in paddle, the move of the belt roller, and opening/closing of the openable guide. The stapling control portion 709 controls the stapling process of the stapler 132.

<Buffering Process>

Next, a buffering process will be described with reference to FIGS. 7 through 14. The buffering process is carried out such that a plurality of leading sheets of a succeeding sheet bundle to be processed next is overlapped and made stand by during when a process such as stapling process is implemented on a preceding sheet bundle on the intermediate processing tray (on the sheet stacking portion) 138, and the plurality of overlapped sheets which has been made stand by is discharged to the intermediate processing tray 138 after discharging the preceding sheet bundle.

That is, the buffering process includes a sheet overlapping process of making the plurality of sheets stand by while overlapping them during when the preceding sheet bundle is processed, and a discharging process of discharging the sheets overlapped by the sheet overlapping process to the intermediate processing tray 138 for alignment.

Figure 8A:
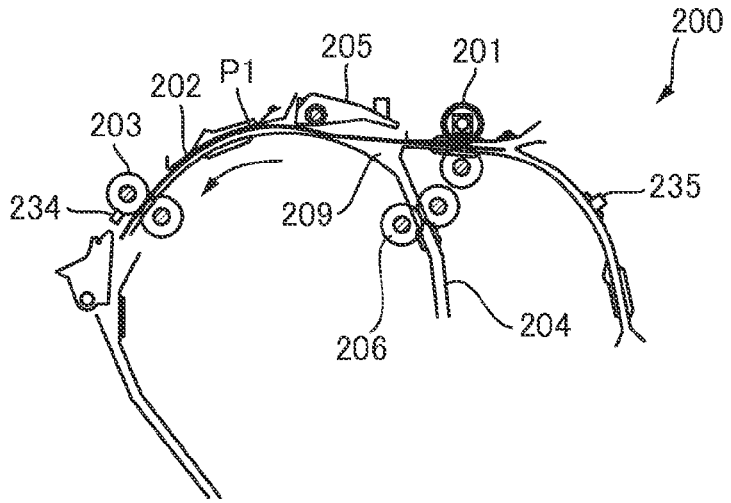
FIG. 8A is a schematic diagram showing a condition in which a first sheet is passed to a first buffer roller pair in the sheet overlapping operation of the finisher.

The sheet overlapping process is carried out by the buffering processing portion 200 which includes the conveying roller pair 201 and first and second buffer roller pairs 203 and 206 as shown in FIGS. 2 and 8A. The buffering processing portion 200 also includes the branch path 204 formed by branching from the conveying path 202 for conveying sheets, a switching member 205, a conveyance sensor 235, a buffer pass sensor 234, and others.

More specifically, the buffering processing portion 200 is arranged to make the sheets stand by at the branch path 204 which is a curved path branched downward from the conveying path 202 at a branch point 209. The branch path 204 composes a standby portion in which a sheet to be processed next stands by during when the preceding sheet bundle is processed on the intermediate processing tray (sheet stacking portion) 138 that stacks sheets to be processed.

The conveying roller pair 201 also composes a first sheet conveying portion that conveys the sheet conveyed to the finisher 100 toward the intermediate processing tray 138, and the first buffer roller pair 203 provided on the conveying path 202 between the conveying roller pair 201 and the intermediate processing tray 138 composes a second sheet conveying portion that rotates reversely and conveys the sheet to the branch path 204, i.e., the standby portion. Furthermore, a second buffer roller pair 206 composes a third sheet conveying portion that is provided such that the second buffer roller pair 206 rotates in normal and reverse directions along the branch path (standby portion) 204, reversely rotates to draw the sheet conveyed to the branch path 204 by the first buffer roller pair 203 into the branch path 204 to make the sheet stand by in the branch path 204, and normally rotates to draw the standby sheet out of the branch path 204 and to convey the standby sheet to the first buffer roller pair 203. It is noted that the direction of the rotation of the rollers that convey the sheet toward the intermediate processing tray 138 in the sheet conveying direction will be referred to as the 'normal direction' or simply as 'normally' and the direction of rotation opposite from this normal direction will be referred to as the 'reverse direction' or simply as 'reversely' hereinafter in the present embodiment.

Next, the sheet overlapping process implemented by the buffering processing portion 200 will be described with reference to a flowchart shown in FIG. 7. When the sheet overlapping process is started, the finisher control portion 636 determines a number of sheets to be overlapped (final number of sheets to be overlapped) N first in response to contents of a job input in Step 1 in FIG. 7. Then, as shown in FIG. 8A, the finisher control portion 636 moves the switching member 205 to a normal conveying position to lead a sheet to the first buffer roller pair 203 in Step 2, and rotates the first buffer roller pair 203 in the normal direction in Step 3 to pass the sheet P1 conveyed from the conveying roller pair 201 to the first buffer roller pair 203.

Figure 8B:
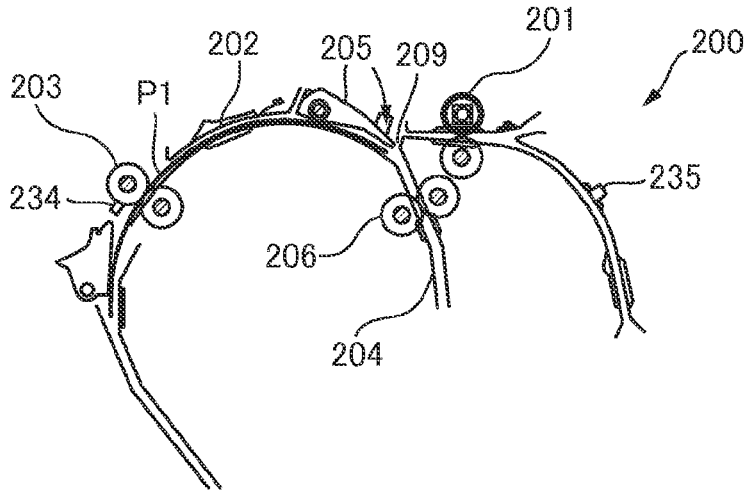
FIG. 8B is a schematic diagram showing a condition in which the first buffer roller pair is reversed and the first sheet is conveyed to a branch path.

A buffer pass sensor 234 provided in the vicinity of a downstream side of the first buffer roller pair 203 detects a moment when the sheet P1 is passed to the first buffer roller pair 203, and in response to a result of the buffer pass sensor 234 that turns ON, i.e., Yes in Step 4, the finisher control portion 636, i.e., the control portion that controls the first and second buffer roller pairs 203 and 206, stops the first buffer roller pair 203 after a predetermined period of time in Step 5. In response also with the stoppage of the first buffer roller pair 203, the finisher control portion 636 switches the switching member 205 to a branch path conveying position that leads the sheet to the branch point 209 as shown in FIG. 8B in Step 6. It is noted that the sheet P1 is conveyed until when a rear end thereof passes through the branch point 209, and a conveying length (the abovementioned predetermined time) until when the rear end of the sheet P1 passes through the branch point 209 is preset based on the detection timing of the front end of the sheet detected by the buffer pass sensor 234 and sheet sizes input in advance.

Figure 8C:
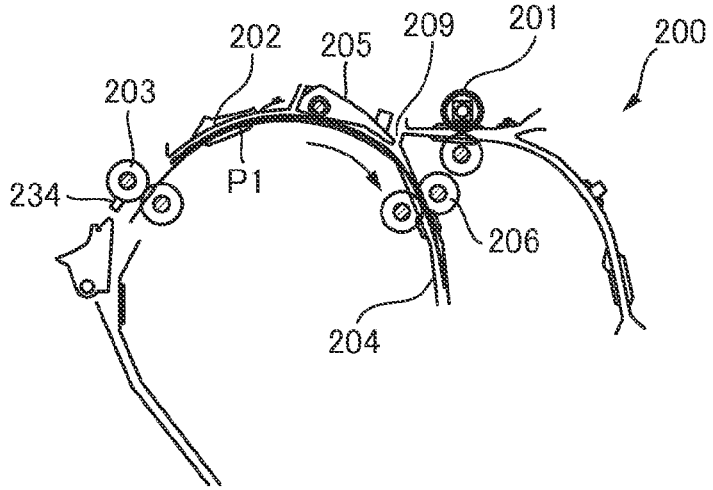
FIG. 8C is a schematic diagram showing a condition in which the first sheet is passed to a second buffer roller pair.

Next, the finisher control portion 636 drives the first buffer roller pair 203 reversely in Step 7, and in response to a result of the buffer pass sensor 234 that turns OFF, i.e., Yes in Step 8, stops the second buffer roller pair 206 after a predetermined period of time in Step 9. Thereby, the sheet P1 is drawn into the branch path 204 and is conveyed by a certain length by being passed to the second buffer roller pair 206 as shown in FIG. 8C. It is noted that the buffer pass sensor 234 detects the conveying length of the sheet conveyed by the first buffer roller pair 203 rotating in the reverse direction as described above. The conveying length of the second buffer roller pair 206 is controlled by a length obtained after when the sheet end portion passes through the buffer pass sensor 234. Because the sheet P1 is a first standby sheet, it is a sheet whose number of times of being drawn into the branch path 204 is most during the sheet overlapping process.

Figure 9A:
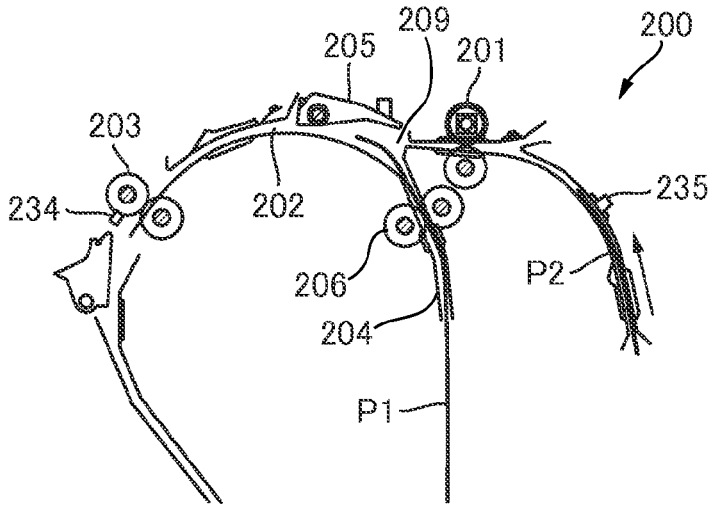
FIG. 9A is a schematic diagram showing a condition in which a succeeding sheet comes to be conveyed in the sheet overlapping operation of the finisher.

When the second buffer roller pair 206 stops, the finisher control portion 636 switches the switching member 205 to the normal conveying position again as shown in FIG. 9A in Step 10, and determines a time T (N, n) until starting to normally drive the second buffer roller pair 206 after when a conveyance sensor 235 detailed later turns ON in Step 11. It is noted that the conveyance sensor (detecting portion) 235 is disposed upstream and in the vicinity of the conveying roller pair 201 and detects timing when a front end of a succeeding sheet P2 passes through.

Figure 9B:
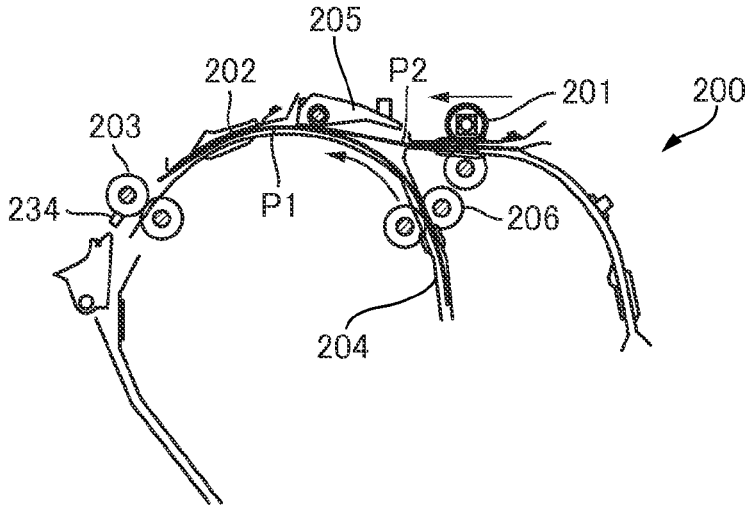
FIG. 9B is a schematic diagram showing a condition in which the first sheet that has stood by at the branch path is conveyed to a conveying path concurrently with the succeeding sheet.

When this time T (N, n) is determined, the finisher control portion 636 monitors the conveyance sensor 235 in Step 12, and in response to a result of the conveyance sensor 235 that turns ON, i.e., Yes in Step 13, drives the buffer motor M1 to normally drive the second buffer roller pair 206 after passing the time T (N, n) as shown in FIG. 9B in Step 14.

Figure 9C:
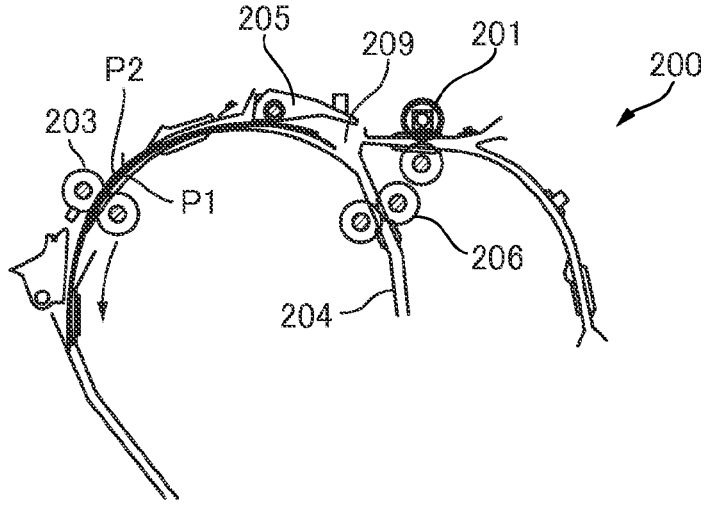
FIG. 9C is a schematic diagram showing a condition in which the first sheet is overlapped with the succeeding sheet.

Then, the sheet P1 joins and overlaps with the succeeding sheet P2. That is, the sheet conveyed by the conveying roller pair 201 is overlapped on the sheet conveyed to the branch path 204, i.e., the curved path, while being shifted downstream in the sheet conveying direction. After that, the sheet P1 and the succeeding sheet P2 are passed to the first buffer roller pair 203 in a condition shifted and overlapped with each other as shown in FIG. 9C. At this time, the first buffer roller pair 203 is also normally driven.

Next, the finisher control portion 636 judges whether or not the overlapped sheet is a final sheet to be overlapped in Step 15, and when it is not the final sheet, i.e., No in Step 15, the finisher control portion 636 returns the process to Step 4 to implement the processes of Steps 4 through 14 described above. When the overlapped sheet is the final sheet to be overlapped, i.e., Yes in Step 15, the finisher control portion 636 finishes the sheet overlapping process and conveys the sheet bundle downstream by the first buffer roller pair 203.

Figure 10A:
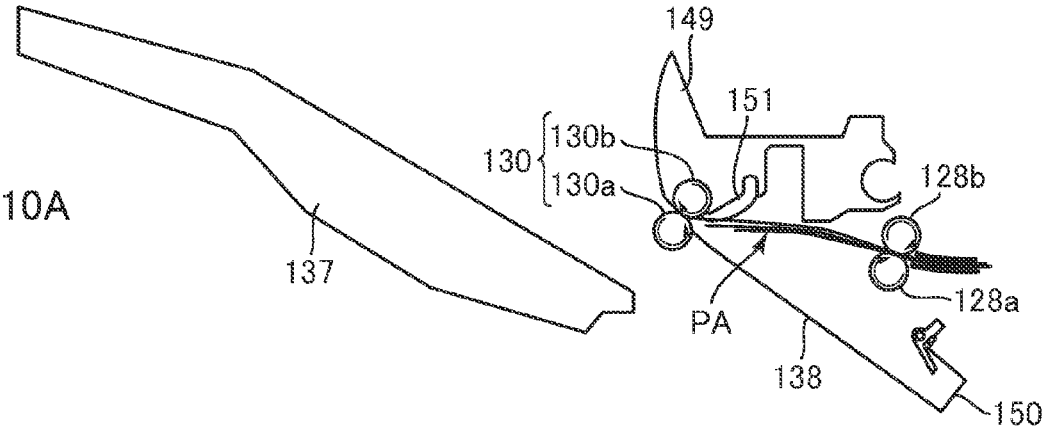
FIG. 10A is a schematic diagram showing a condition in which overlapped buffered sheets are discharged to an intermediate processing tray in the sheet overlapping operation.

The plurality (n sheets) of overlapped and buffered sheets PA conveyed by the first buffer roller pair 203 is led from a lower discharge roller pair 128 to a nip portion of a bundle discharge roller pair 130 along a guide 151 as shown in FIG. 10A. At this time, the openable guide 149 is closed and the rollers of the bundle discharge roller pair 130 are in pressure contact with each other. The bundle discharge roller pair 130 also rotates in a direction of discharging the buffered sheets PA to the stacking tray 137.

Figure 10B:
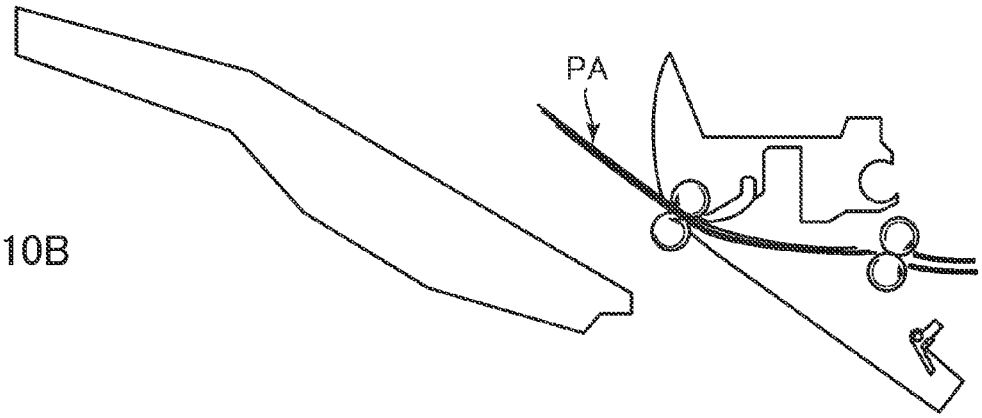
FIG. 10B is a schematic diagram showing a condition in which the buffered sheets are passed to a discharge roller pair.
Figure 10C:
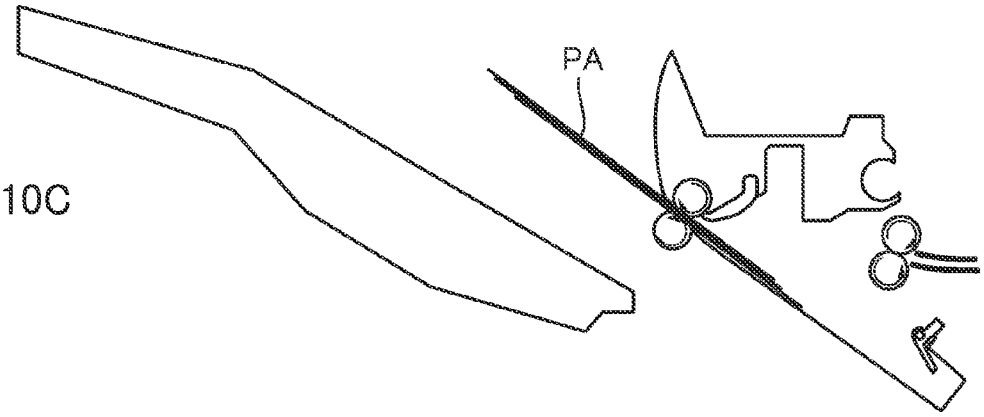
FIG. 10C is a schematic diagram showing a condition in which passing of the buffered sheets to the discharge roller pair is completed.
Figure 11A:
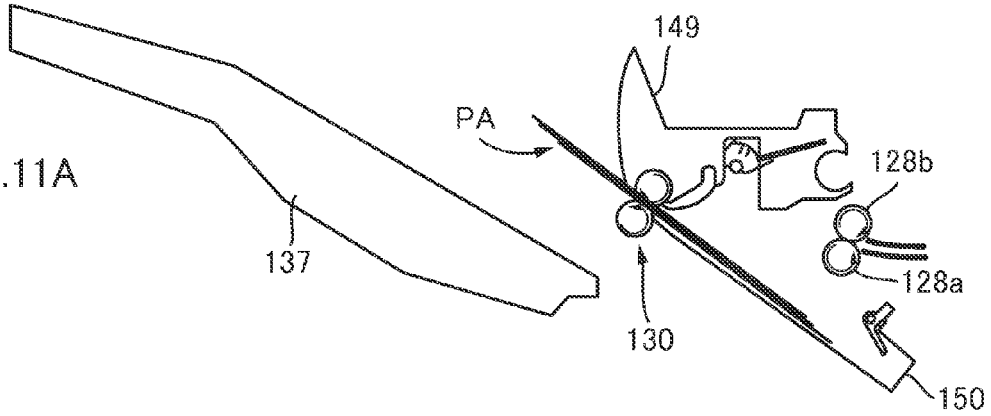
FIG. 11A is a schematic diagram showing a condition in which the buffered sheets are conveyed to the rear end stopper by rotating the discharge roller pair in a reverse direction.

With this arrangement, the buffered sheets PA passed to the bundle discharge roller pair 130 are conveyed in the direction of being discharged to the stacking tray 137 as they are until when a rear end thereof passes through the lower discharge roller pair 128 as shown in FIG. 10B. Then, in response to the rear end of the buffered sheets PA that passes through the lower discharge roller pair 128 and is stacked on the intermediate processing tray 138 as shown in FIG. 10C, the bundle discharge roller pair 130 rotates in the reverse direction as shown in FIG. 11A. Thereby, the buffered sheets PA are conveyed in a direction of abutting against the rear end stopper 150 provided upstream in the sheet conveying direction (downstream in a direction of releasing the sheets) of the intermediate processing tray 138.

Figure 11B:
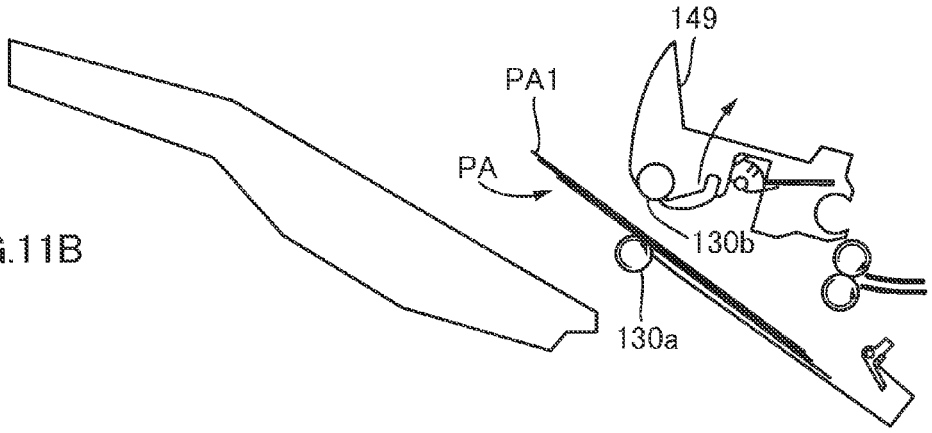
FIG. 11B is a schematic diagram showing a condition in which an openable guide opens and the buffered sheets are released from the discharge roller pair.

The openable guide 149 is opened and thereby the bundle discharge rollers 130*a* and 130*b* separate from each other as shown in FIG. 11B before the buffered sheets PA abut against the rear end stopper 150, so that the buffered sheets PA are released toward the rear end stopper 150. At this time, the buffered sheets PA are overlapped in the condition in which the succeeding sheet shifts with respect to the preceding sheet among the sheets in contact with each other by a predetermined shift length downstream in the sheet conveying direction when the sheets are overlapped with each other in the sheet overlapping process described above. Therefore, when the openable guide 149 is opened, the buffered sheets PA abut against the rear end stopper 150 basically in the condition in which the sheets are shifted from each other.

In response to the timing when the openable guide 149 is opened, each of the draw-in paddle 131 and the belt roller 158 rotates in the direction of abutting the buffered sheets PA to the rear end stopper 150, so that each of the draw-in paddle 131 and the belt roller 158 comes in contact with and moves an uppermost buffered sheet PA1 located at an upper surface of the buffered sheets PA toward the rear end stopper 150.

Figure 11C:
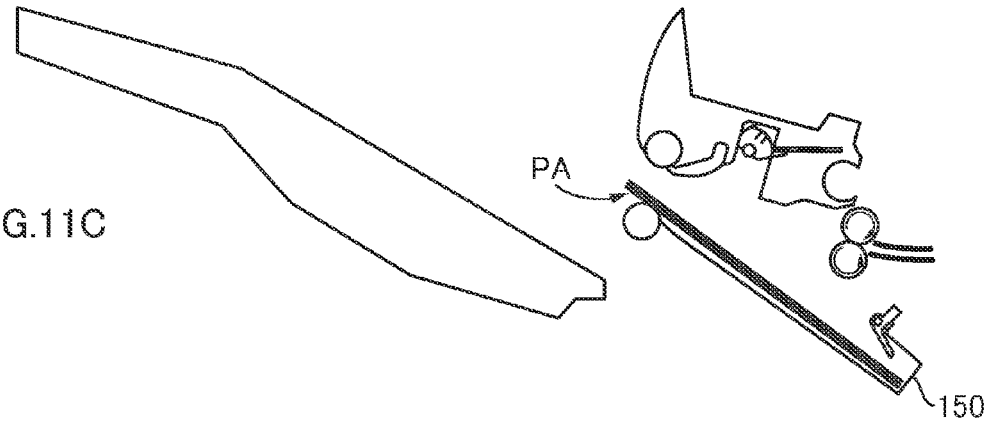
FIG. 11C is a schematic diagram showing a condition in which the buffered sheets are aligned.

Then, because the uppermost sheet PA1 is moved, each sheet of the overlapped and buffered sheets PA moves in a direction of eliminating the shift between the sheets by friction between the sheets. Thus, a downstream end in the release direction of each buffered sheet abuts against the rear end stopper 150 and is aligned as shown in FIG. 11C. Thus, the buffering process is finished.

It is noted that in response to the alignment of the buffered sheets PA, another succeeding sheet is stacked on the buffered sheets PA and a sheet bundle is formed. At this time, the bundle discharge rollers 130*a* and 130*b* are kept separated and the succeeding sheet discharged to the intermediate processing tray 138 from the lower discharge roller pair 128 is led to the belt roller 158 by the drawn-in paddle 131. Then, the belt roller 158 abuts the sheet against the rear end stopper 150 to align the sheet in the sheet conveying direction. When the alignment in the sheet conveying direction ends, the sheet is aligned in the width direction by the side edge restricting portion. After that, the stapler 132 implements the stapling process on the sheet bundle.

<Overlap Length of Sheets>

Figure 12:
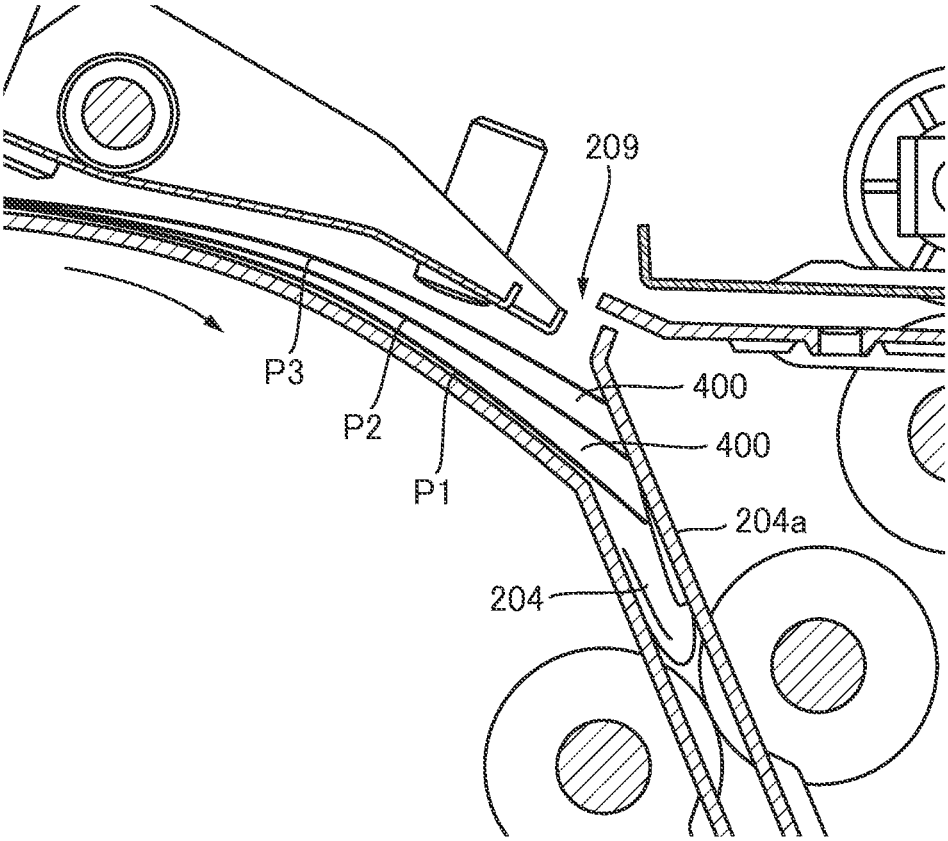
FIG. 12 is a schematic diagram explaining moves of the sheets in passing through the branch path of the finisher.
Figure 13:
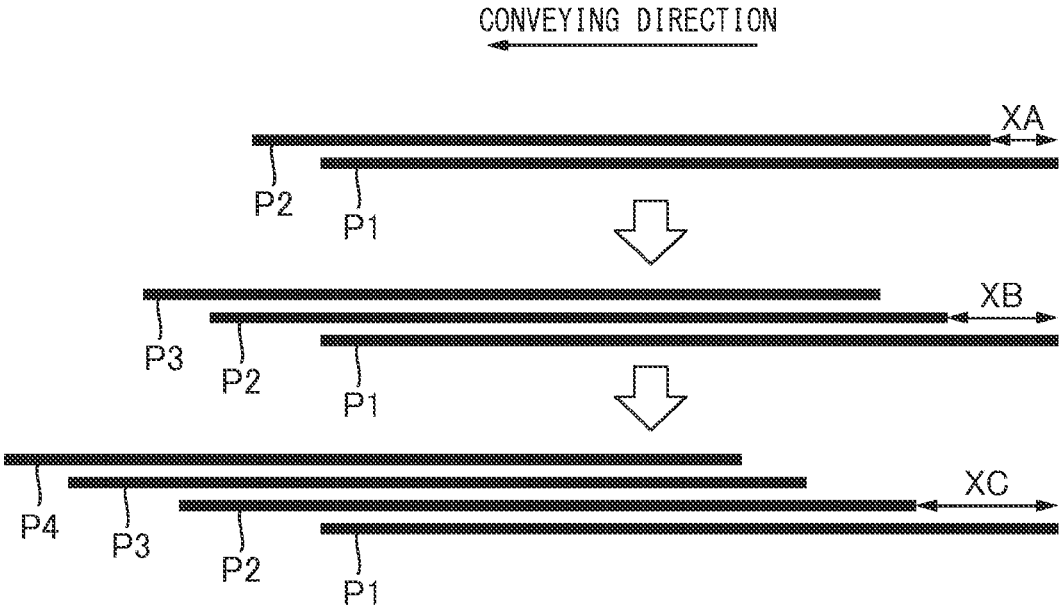
FIG. 13 is a schematic diagram explaining changes of shift lengths of the sheets generated in passing through the branch path.

Next, the sheet overlap length in the sheet overlapping operation will be explained in detail with reference to FIG. 7 and based on FIGS. 12 through 14. As described above, the buffered sheets PA are overlapped while being shifted in the inclination direction of the intermediate processing tray 138 such that the sheets can be aligned with each other on the intermediate processing tray 138 in the sheet overlapping operation.

By the way, the shift length between the buffered sheets increases during when the buffered sheets move in and out of the branch path 204 in the sheet overlapping operation. That is, as shown in FIG. 12, when the overlapped buffered sheets (three sheets in FIG. 12) are returned to the branch path 204 to overlap with a sheet to be conveyed next, the buffered sheets P1, P2 and P3 deflect by abutting against a guide 204*a* provided on a side of the branch path at the branch point 209 between the conveying path 202 and the branch path 204, and gaps 400 are created between the sheets P1 and P2 and between sheets P2 and P3. When the gaps 400 are created between the sheets P1, P2 and P3 as described above, abutting angles of the upper overlapped sheet P2 and P3 that come in contact with the guide 204*a* increase.

As a result, a difference of resistance is generated between the upper and lower sheets, and the shift length between the sheets is widened from an initial length during the conveyance. For example, a shift length between the first and second sheets P1 and P2 when the two sheets are overlapped as shown in FIG. 13 is represented to be XA, a shift length between the first and second sheets P1 and P2 when another sheet is overlapped in the condition described above, i.e., when the three sheets are overlapped, is represented to be XB, and a shift length between the first and second sheets P1 and P2 when one more sheet is overlapped, i.e., when four sheets in total are overlapped, is represented to be XC. Then, even if the shift length in overlapping the respective sheets is set to be equal, a relationship of the shift lengths at the point of time when the four buffered sheets are overlapped turns out to be XA<XB<XC due to the difference of resistance between the upper and lower sheets.

That is, even if the first and second sheets that are in contact with each other are overlapped in the condition of being shifted by the shift length X, the more the number of times when the overlapped sheets are drawn into the branch path 204, i.e., the more the number of sheets to be overlapped, the more the actual shift length between the sheets increases.

If the shift length between the buffered sheets is too small, there is a case when the direction of the shift between the sheets is reversed due to a shift of timing in overlapping the sheets and to the conveyance resistance during conveyance of the sheets, causing such a case when an overlapped lower sheet does not reach the rear end stopper 150 even though an overlapped upper sheet reaches the rear end stopper 150 by the draw-in paddle 131. When the shift length is too large in contrary, there is a case of causing such misalignment that only one of the overlapped lower sheets abuts first against the rear end stopper 150 and buckles or the overlapped upper sheet does not reach the rear end stopper 150. Accordingly, in order to prevent such misalignment, it is necessary to convey the standby sheets (buffered sheets) while shifting by an adequate predetermined length in the sheet conveying direction in conveying them to the intermediate processing tray 138.

Then, the shift length in overlapping the sheets in contact with each other is changed corresponding to a number of sheets to be finally overlapped in the present embodiment. That is, each sheet conveyed sequentially by the sheet conveying roller pair 201 is overlapped with a preceding buffered sheet (standby sheet) such that the sheet shifts sequentially in the sheet conveying direction of the sheet conveying roller pair 201, and the overlapped sheets are made stand by at the branch path 204. The present embodiment is then arranged such that the more the number of times of drawal into the branch path 204 of the sheet, the shorter the shift length in overlapping with a sheet conveyed next is so that the shift lengths between the sheets is substantially equalized to the predetermined shift length in overlapping the standby sheets with a sheet finally conveyed and conveying them to the intermediate processing tray 138.

More specifically, when a number of sheets to be finally overlapped is represented as 'N', a number of sheets standing by at the branch path 204 as 'n', a length shifting in one overlapping operation as 'x', and a target shift length when the sheets are finally overlapped, i.e., a target shift length in overlapping a final sheet or the predetermined shift length, as 'X', a target shift length in the overlap is represented as $X-(N-n-1)\times x$. Then, in accordance with that, the timing for driving the second buffer roller pair 206 after detecting the succeeding sheet by the conveyance sensor 235 is changed.

Figure 7:
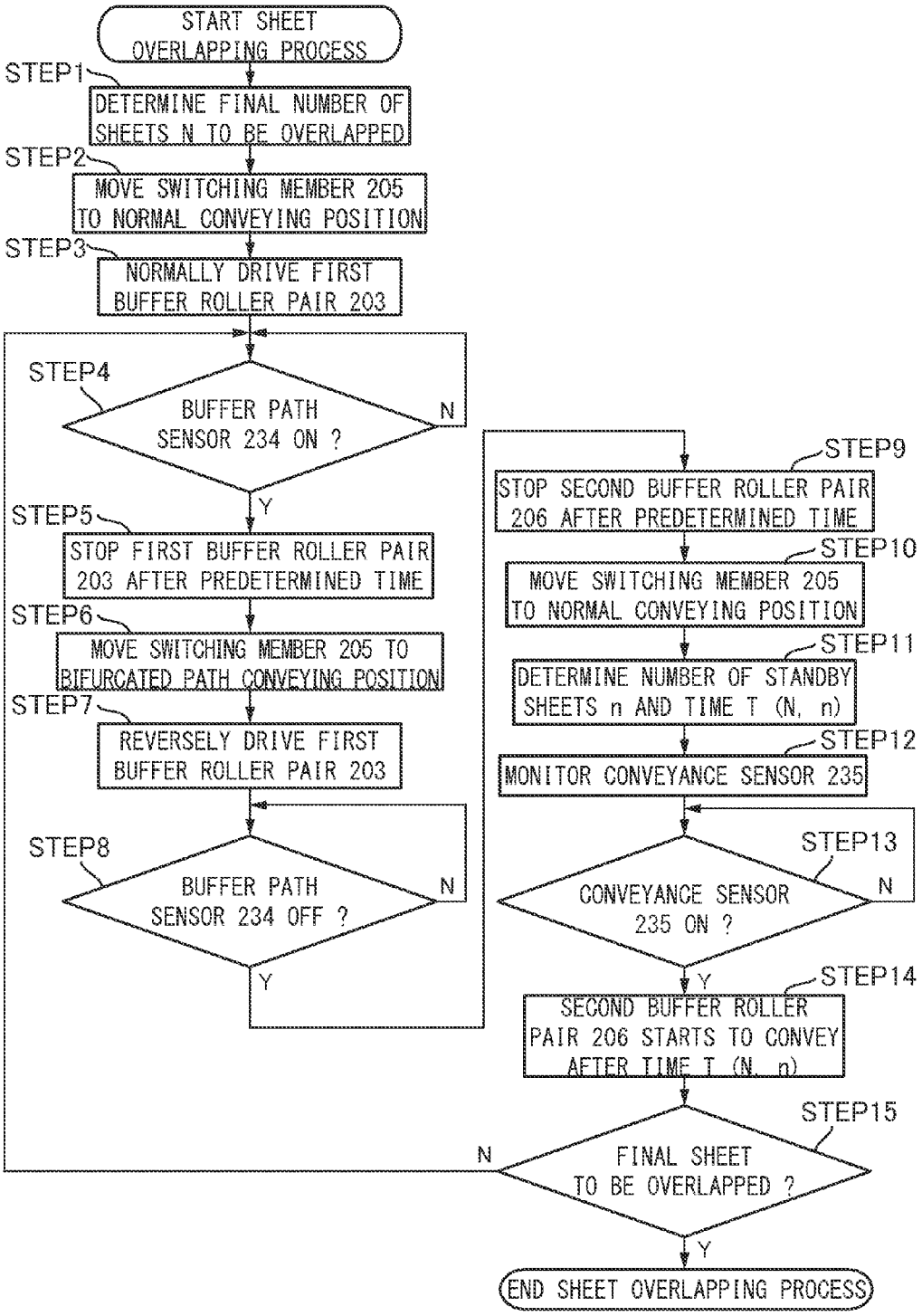
FIG. 7 is a flowchart explaining a sheet overlapping operation of the finisher.

That is, after when the conveyance sensor 235 turns ON, the finisher control portion 636 sets such that the shift length in overlapping the sheets is substantially equalized to $(X-(N-n-1)\times x)$ in determining the time T (N, n) until starting to normally drive the second buffer roller pair 206 in Step 11 in FIG. 7.

The time T set as described above makes it possible to shorten the shift length of the sheet P1 conveyed first to the branch path 204 in overlapping with the next sheet P2 from the predetermined shift length sequentially in accordance to the number of sheets to be made stand by. That is, the shift length of the sheet P1, conveyed first to the branch path 204 among the plurality of sheets, in overlapping with the next sheet P2 in making the plurality of sheets stand by within the branch path 204 is shortened sequentially to be less than the predetermined shift length X such that the more the number of sheets (n) made stand by in the branch path 204, the shorter the shift length of the sheet P1 is. In other words, the more the number of times of drawal into the branch path 204 of the overlapped standby sheet, the shorter the shift length in overlapping with the conveyed sheet becomes such that the shift length is shortened sequentially from the predetermined shift length. To put it still another way, the control portion sets the shift length with respect to the standby sheet just preceding to the sheet conveyed by the conveying roller pair 201 (first sheet conveying portion) in overlapping the sheet conveyed by the conveying roller pair 201 with the overlapped standby sheet to be less in proportion to a number of times of drawal into the branch path 204 (standby portion) of the overlapped standby sheet during the sheet bundle on the intermediate processing tray (sheet stacking portion) 138 being processed so that shift lengths between the respective sheets are substantially equalized to a predetermined shift length in overlapping a finally conveyed sheet with the overlapped standby sheet and conveying those overlapped sheets to the sheet stacking portion.

Figure 14A:
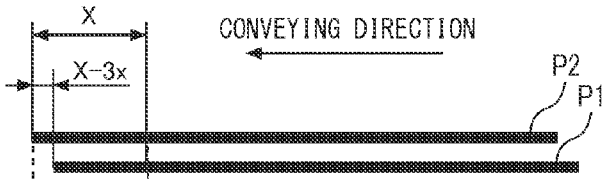
FIGS. 14A through 14D are schematic diagrams explaining how the finisher controls the shift lengths of the sheets.
Figure 14B:
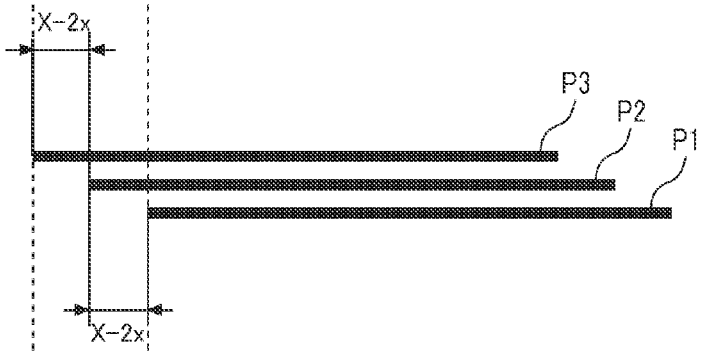

For instance, when five overlapped buffered sheets are to be conveyed, the time T (N, n) is set such that a shift length of a front end of the second sheet P2 is X−3x with respect to the first sheet P1 as shown in FIG. 14A. A shift length of a front end of a third sheet P3 is set to be X−2x with respect to the second sheet P2 as shown in FIG. 14B. It is noted that at this time, the shift length of the first and second sheets P1 and P2 is enlarged to be X−2x because these first and second sheets P1 and P2 are drawn once into the branch path 204.

Figure 14C:
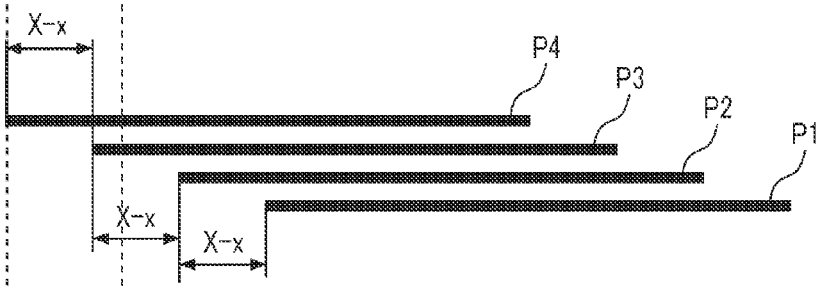
Figure 14D:
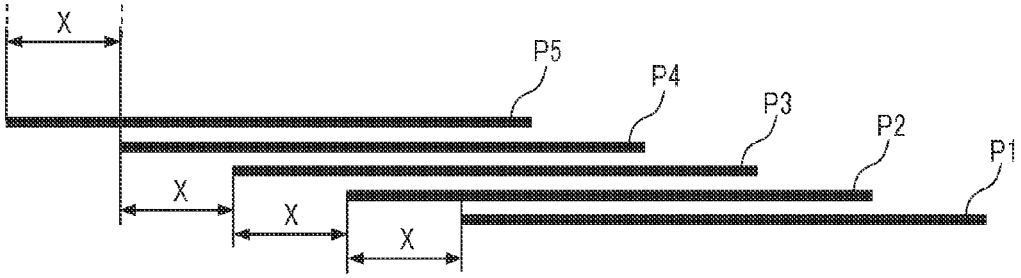

In conveying a fourth sheet P4, a shift length thereof with respect to the third sheet P3 is set to be X−x, i.e., to be slightly larger than the case of the third sheet in the same manner, and the shift lengths between the first and second sheet and between the second and third sheets are also X−x at this time as shown in FIG. 14C. Then, as shown in FIG. 14D, a shift length between a fifth sheet P5, i.e., the final sheet, and the fourth sheet P4 is set to be X, i.e., the predetermined shift length, and all of the shift lengths between the other sheets are also set to be X at this time.

As described above, the drive of the buffer motor M1 is controlled such that the timing for starting to normally rotate the second buffer roller pair 206 is quickened in overlapping the sheet P1 with the sheet P2, i.e., the first conveyed sheet, in the present embodiment. This arrangement makes it possible to shorten the shift length in overlapping with the sheet P1, i.e., the standby sheet, with the sheet P2 to be less than the predetermined shift length X as shown in FIGS. 14A through 14D. Then, the timing for starting to normally rotate the second buffer roller pair 206 is sequentially retarded every time when the number of sheet overlapping times is incremented within one and same sheet overlapping process, and the shift length between the sheets in overlapping a finally conveyed sheet with the standby sheet and conveying the sheets to the intermediate processing tray is substantially equalized to the predetermined shift length X.

That is, the finisher control portion 636 controls the buffer motor (drive portion) M1 based on the sheet detecting timing detected by the conveyance sensor (detecting portion) 235 in overlapping a sheet conveyed next (sheet conveyed by the first sheet conveying portion) with the overlapped standby sheet such that the more the number of times of drawal into the branch path (standby portion) 204 of the overlapped standby sheet, the faster the timing for starting to normally rotate the second buffer roller pair (third sheet conveying portion) 206. In other words, the control portion drives the drive portion such that the shift length in overlapping the sheet conveyed by the first sheet conveying with the overlapped standby sheet is reduced by relatively quacking the timing for starting to normally rotate the third sheet conveying portion based on the sheet detecting timing.

This arrangement makes it possible to adequately control the shift lengths between the respective sheets even in overlapping a large number of sheets in the same manner with a case of overlapping a small number of sheets and to implement the sheet standby process without causing misalignment. That is, it is possible to make the shift lengths between the respective sheets constant regardless of a number of sheets to be finally overlapped and to align the sheets overlapped in the intermediate processing section. Along with that, it becomes also possible to align ends of the sheets properly and to implement the sheet processing in high quality without dropping image forming speed even in a high-speed image forming apparatus.

It is noted that although the succeeding sheet is shifted downstream in the sheet conveying direction from the preceding sheet because the rear end stopper 150 receives the upstream end in the sheet conveying direction of the sheet in the present embodiment, the succeeding sheet may be shifted upstream in the sheet conveying direction when the rear end stopper 150 receives a downstream end in the sheet conveying direction of the sheet.

Still further, although the second buffer roller pair 206 is provided along the branch path 204, i.e., the standby portion, in the above explanation, it is also possible to arrange such that the sheet overlapping operation can be implemented by drawing a sheet into the branch path 204 only by the first buffer roller pair 203 while adjusting position of the first buffer roller pair 203 and sizes of the sheets to be used. The image forming apparatus may be also any image forming apparatus such as a monochrome copier or a printer that forms an image on a sheet.

Second Embodiment

Next, a second embodiment of the invention will be described. It is noted that while the time for starting to normally drive the second buffer roller pair 206 has been set such that the shift length is substantially equalized to (X−(N−n−1)×x in the first embodiment, the second embodiment is different from the first embodiment in that driving speed (sheet conveying speed) of the second buffer roller pair 206 is set such that the shift length is substantially equalized to (X−(N−n−1)×x. Accordingly, only parts different from the first embodiment will be described in the following explanation and a description of common or corresponding parts will be omitted here.

Figure 15:
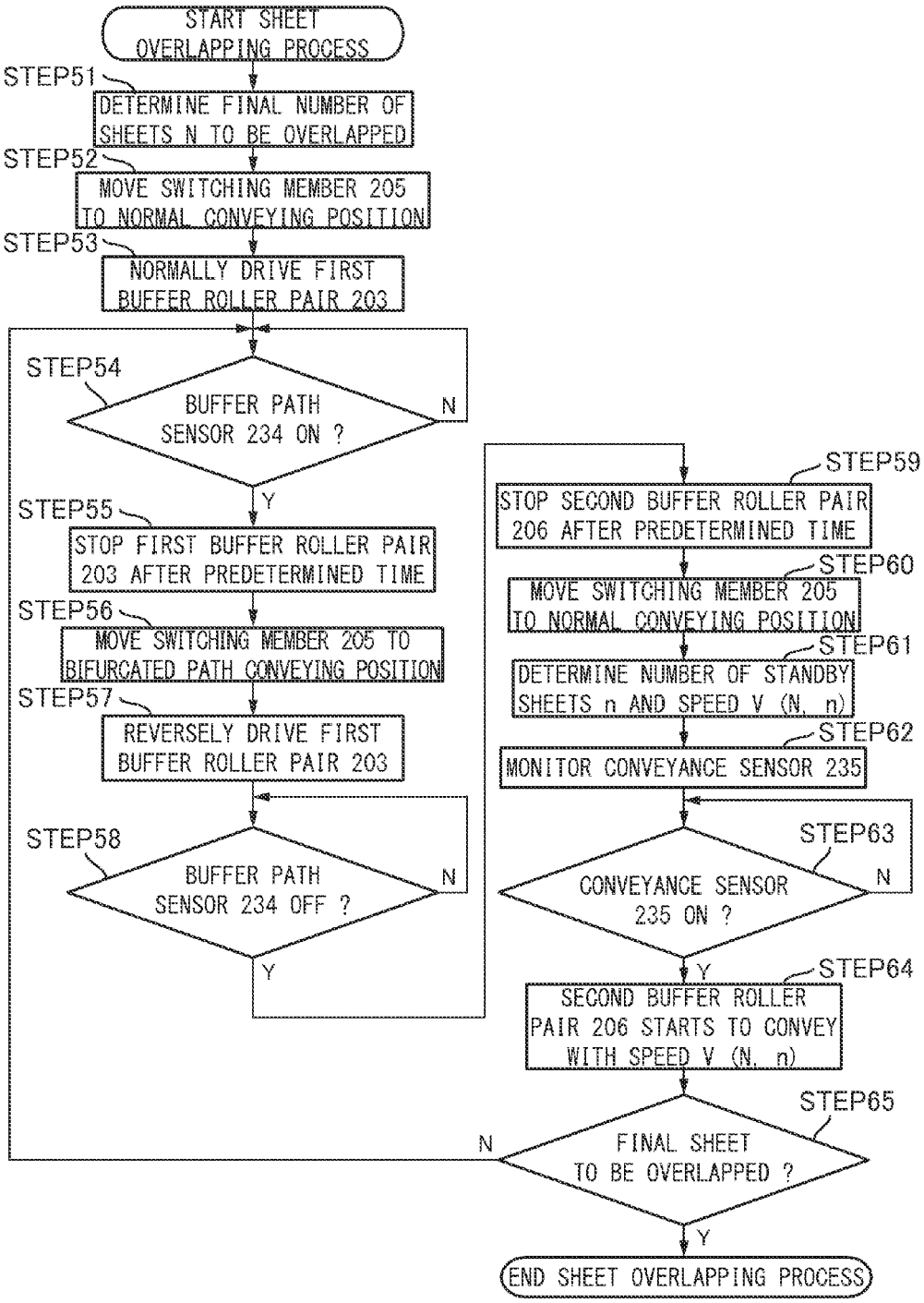
FIG. 15 is a flowchart explaining a sheet overlapping operation of a finisher of a second embodiment.

FIG. 15 is a flowchart illustrating a sheet overlapping process and operation of the present embodiment, and the sheet overlapping process of the present embodiment will be explained below with reference to FIG. 15. When the sheet overlapping process of overlapping sheets is started, the finisher control portion 636 controls Steps 51 through 60 in FIG. 15 in the same manner with the first embodiment.

Then, the finisher control portion 636 determines speed V (N, n) that varies depending on a number of standby sheets (n) currently existing within the branch path 204 and a number of sheets N to be finally overlapped in Step 61. It is noted that the speed V (N, n) is a sheet conveying speed of the second buffer roller pair 206 after when the conveyance sensor 235 turns ON and is set such that a shift length in overlapping the sheets is substantially equalized to (X−(N−n−1)×x).

After determining the speed V (N, n), the finisher control portion 636 monitors the conveyance sensor 235 in Step 62. In response to the conveyance sensor 235 turning ON, i.e., Yes in Step 63, the finisher control portion 636 controls the drive of the buffer motor M1 after a predetermined period of time to drive the second buffer roller pair 206 in the normal direction with the speed V (N, n) in Step 64. The finisher control portion 636 also drives the first buffer roller pair 203 in the normal direction. Thereby, the sheet P1 is overlapped with the succeeding sheet P2 as described with reference to FIG. 9B, and the sheet P1 and the succeeding sheet P2 are then passed to the first buffer roller pair 203 while being overlapped as shown in FIG. 10C described above.

Then, the finisher control portion 636 judges whether or not the overlapped sheet is a final sheet to be overlapped in Step 65, and when the sheet is not the final sheet, i.e., No in Step 65, the finisher control portion 636 returns the process to Step 55 to implement the processes in Steps 54 through 64 described above. When the overlapped sheet is the final sheet to be overlapped, i.e., Yes in Step 65, the sheet overlapping process is finished and the sheet bundle is conveyed downstream by the first buffer roller pair 203.

As described above, the drive of the buffer motor M1 is controlled such that the normal rotational speed of the second buffer roller pair 206 is quickened in overlapping the sheet P1 with the sheet P2 in the present embodiment. This arrangement makes it possible to shorten the shift length in overlapping the sheet P1, i.e., the standby sheet, with the sheet P2 to be less than the predetermined shift length X. Then, the drive of the buffer motor M1 is controlled such that the normal rotational speed of the second buffer roller pair 206 is sequentially retarded every time when the number of sheet overlapping times is incremented within one and same sheet overlapping process.

That is, the finisher control portion 636 controls the buffer motor (drive portion) M1 based on the sheet detecting timing detected by the conveyance sensor 235 in overlapping with a sheet conveyed next such that the more the number of times of drawal into the branch path 204 of the sheet is, the faster the normal rotational speed of the second buffer roller pair (third sheet conveying portion) 206 is. In other words, the control portion drives the drive portion based on a sheet detecting timing detected by the detecting portion such that the shift length in overlapping with the sheet conveyed next is reduced by relatively increasing normal rotational speed of the third sheet conveying portion.

As a result, it is possible to substantially equalize the shift length between the sheets to the predetermine shift length X in overlapping the final conveyed sheet with the standby sheet and conveying them to the intermediate processing tray. This arrangement makes it possible to adequately control the shift length between the sheets even in overlapping a large number of sheets in the same manner with a case of overlapping a small number of sheets and to implement the sheet standby process without causing misalignment.

It is noted that while the sheet conveying speed of the second buffer roller pair 206 is changed in the present embodiment, the sheet conveying speed of the succeeding sheet may be changed by changing not the speed of the second buffer roller pair 206 but the sheet conveying speed of the sheet conveying roller pair 201. That is, it is possible to arrange such that the finisher control portion 636 controls the conveyance motor M2 based on the sheet detecting timing detected by the conveyance sensor 235 in overlapping with a sheet conveyed next such that the more the number of times drawal into the branch path 204 of the sheet, the slower the sheet conveying speed of the conveyance roller pair (first sheet conveying portion) 201 is. In other words, the control portion drives the drive portion based on the sheet detecting timing detected by the detecting portion such that the shift length in overlapping the sheet conveyed by the first sheet conveying portion with the overlapped standby sheet is reduced by relatively retarding the sheet conveying speed of the first sheet conveying portion.

That is, the conveyance motor M2 may be controlled such that the sheet conveying speed of the sheet conveying roller pair 201 is sequentially quickened every time when the number of sheet overlapping times is incremented from the overlap of the beginning sheets.

By the way, while the finisher 100 adopting the switchback system that reversely conveys a sheet on the way of its conveyance and makes the sheet temporarily stand by at the branch path 204 has been explained in the first and second embodiments described above, the invention is not limited to such configuration. For instance, the present invention is applicable also to a finisher adopting a winding system shown in FIG. 16 or a plural buffer path system not shown.

Figure 16:
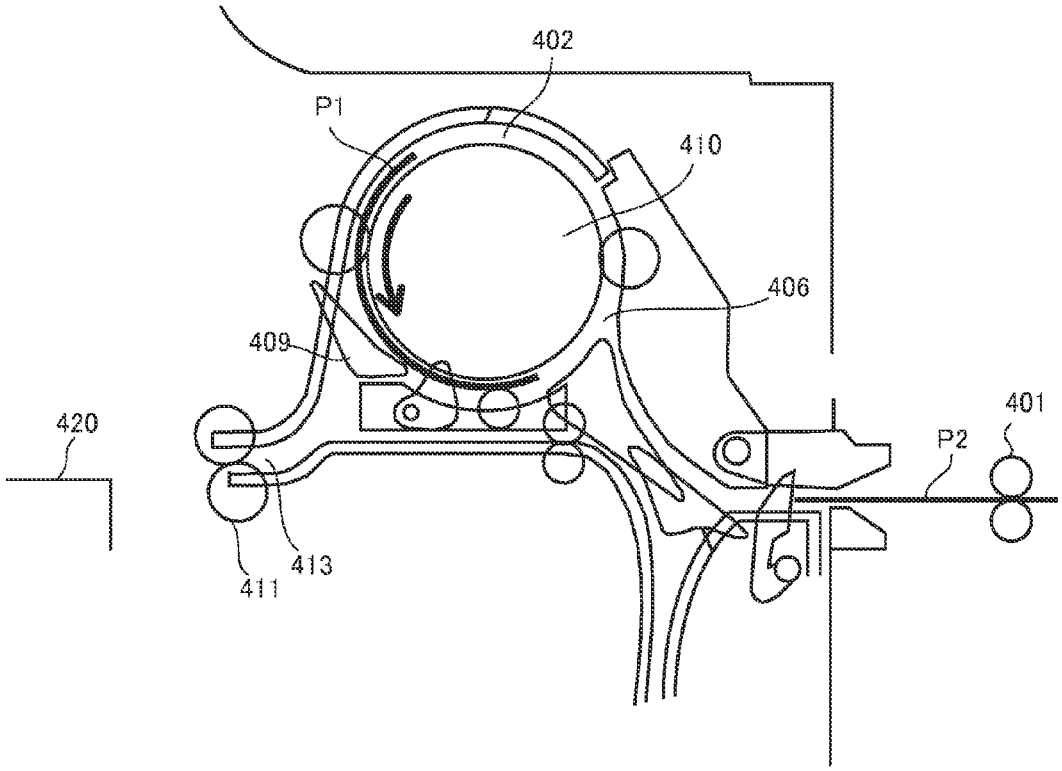
FIG. 16 is a schematic diagram illustrating another configuration of the finisher.

Here, as shown in FIG. 16, the finisher adopting the winding system is arranged such that a preceding sheet P1 conveyed by a first sheet conveying portion 401 stands by temporarily within a circular path 402 formed on a circumferential surface of a buffer roller 410 in implementing a buffering process on the sheet. Then, concurrently with conveyance of a succeeding sheet P2, the buffer roller 410, i.e., a second sheet conveying portion, is rotated counterclockwise to overlap and convey the sheet P1 temporarily standing by at the circular path 402, i.e., the circuit path, that composes a standby portion at a confluent point 406. After repeating this process for a required number of sheets and when the required number of sheets is overlapped, a conveying path switching member 409 is switched to convey the overlapped sheet bundle to a sheet stacking portion 420 by a conveying roller 411 provided on a bundle conveying path 413.

It is noted that in the finisher of the winding system described above, a sheet standby portion is composed of the buffer roller 410, i.e., a second sheet conveying portion, the circular path 402 formed around the circumferential surface of the buffer roller 410, and the conveying roller 411. Although the sheet is conveyed in the direction opposite from the sheet conveying direction in the first and second embodiments described above, the sheet overlapping and conveying processes are carried out while conveying the sheet in the sheet conveying direction in the winding system. Therefore, it is possible to convey a plurality of sheets in the overlapped condition while sequentially increasing the shift lengths by changing timing for starting to rotate the buffer roller 410 or by changing rotational speed of the buffer roller 410 for example.

While the embodiments of the invention have been explained above, the invention is not limited to the embodiments described above. Still further, the effects described in the embodiments of the invention are merely the most suitable effects brought about by the invention and the effects of the invention are not limited by those described in the embodiments of the invention.

Aspects of the present invention can also be realized by a computer (such as a CPU or MPU) of a system or apparatus that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device, e.g., computer-readable medium. In an example, a computer-readable storage medium may store a program that causes a sheet storage apparatus to perform a method described herein. In another example, a central processing unit (CPU) may be configured to control at least one unit utilized in a method or apparatus described herein.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-187639, filed on Aug. 28, 2012 and 2013-160374, filed on Aug. 1, 2013 which are hereby incorporated by reference herein in their entirety.

What is claimed is:

1. A sheet processing apparatus, comprising:

a sheet stacking portion on which a sheet to be processed is stacked;

a first sheet conveying portion configured to convey the sheet toward the sheet stacking portion;

a standby portion branched from a sheet conveying path between the sheet stacking portion and the first sheet conveying portion and which holds on standby a sheet to be processed next while a sheet bundle on the sheet stacking portion is being processed;

a second sheet conveying portion provided along the sheet conveying path between the sheet stacking portion and the standby portion, configured to rotate in normal and reverse directions, and conveying the sheet to the sheet stacking portion by rotating in the normal direction and to the standby portion by rotating in the reverse direction;

a third sheet conveying portion provided in the standby portion so as to rotate in normal and reverse directions, drawing the sheet conveyed to the standby portion by the second sheet conveying portion into the standby portion by rotating in the reverse direction to make the sheet stand by, and drawing the standby sheet out of the standby portion by rotating in the normal direction; and a control portion that drives the second and third sheet conveying portions such that the sheet conveyed sequentially by the first sheet conveying portion overlaps sequentially with the standby sheet drawn out of the standby portion while shifting by a shift length with respect to the standby sheet just preceding to the sheet conveyed by the first sheet conveying portion in a sheet conveying direction and such that the overlapped sheets are conveyed to and made to stand by at the standby portion, the control portion setting the shift length according to a number of sheets drawn into the standby portion.

2. The sheet processing apparatus according to claim 1, further comprising a detecting portion positioned upstream in the sheet conveying direction of the standby portion and detecting a timing of the conveyed sheet passing through; and a drive portion that drives the third sheet conveying portion;

wherein the control portion drives the drive portion based on a sheet detecting timing detected by the detecting portion to quicken the timing for starting to normally rotate the third sheet conveying portion for overlapping a next sheet conveyed by the first sheet conveying portion with the standby sheet whose number of times being drawn into the standby portion set by the control portion is greater.

3. The sheet processing apparatus according to claim 1, further comprising a detecting portion positioned upstream in the sheet conveying direction of the standby portion and detecting a timing of the conveyed sheet passing through; and a drive portion that drives the third sheet conveying portion;

wherein the control portion drives the drive portion based on a sheet detecting timing detected by the detecting portion to drive faster than normal rotational speed of the third sheet conveying portion in overlapping a next sheet conveyed by the first sheet conveying portion with the standby sheet whose number of times being drawn into the standby portion set by the control portion is greater.

4. The sheet processing apparatus according to claim 1, further comprising a detecting portion positioned upstream in the sheet conveying direction of the standby portion and detecting a timing of the conveyed sheet passing through; and a drive portion that drives the first sheet conveying portion;

wherein the control portion drives the drive portion based on the sheet detecting timing detected by the detecting portion to slower the sheet conveying speed of the first sheet conveying portion in overlapping a next sheet conveyed by the first sheet conveying portion with the standby sheet whose number of times being drawn into the standby portion set by the control portion is greater.

5. The sheet processing apparatus according to claim 1, wherein the standby portion has a curved path branched from the sheet conveying path; and wherein the sheet conveyed by the first sheet conveying portion is overlapped on a sheet that has been conveyed to the curved path by shifting downstream in the sheet conveying direction.

6. The sheet processing apparatus according to claim 1, wherein the sheet stacking portion includes a stopper that receives an upstream end in the sheet conveying direction of the sheet.

7. An image forming apparatus, comprising:

an image forming portion configured to form an image on a sheet; and a sheet processing apparatus set forth in claim 1 and configured to process the sheet on which the image has been formed by the image forming portion.

8. The sheet processing apparatus according to claim 1, wherein the control portion setting the shift length to be less in proportion to the number of sheets drawing into the standby portion.

9. The sheet processing apparatus according to claim 1, wherein the control portion controls such that a shift length between a first sheet drawn first into the standby portion and a second sheet succeeding to the first sheet in a case where the number of sheets drawing into the standby portion is a predetermined number of sheets, is less than a shift length in a case where the number of sheets drawing into the standby portion is less than the predetermined number of sheets.

10. The sheet processing apparatus according to claim 1, wherein the control portion controls such that a shift length between the second sheet and a third sheet succeeding to the second sheet and a third sheet succeeding to the second sheet in a case where the number of sheets drawing into the standby portion is predetermined number of sheets is less than a shift length in a case where the number of sheets drawing into the standby portion is less than the predetermined number of sheets.

11. A sheet processing apparatus, comprising:

a sheet stacking portion on which a sheet to be processed is stacked;

a first sheet conveying portion configured to convey the sheet toward the sheet stacking portion;

a standby portion branched from a sheet conveying path between the sheet stacking portion and the first sheet conveying portion and which holds on standby a sheet to be processed next while a sheet bundle on the sheet stacking portion is being processed;

a second sheet conveying portion provided along the sheet conveying path between the sheet stacking portion and the standby portion, configured to rotate in normal and reverse directions, and conveying the sheet to the sheet stacking portion by rotating in the normal direction and to the standby portion by rotating in the reverse direction;

a third sheet conveying portion provided in the standby portion so as to be able to rotate in normal and reverse directions, drawing the sheet conveyed to the standby portion by the second sheet conveying portion into the standby portion by rotating in the reverse direction to make the sheet stand by, and drawing the standby sheet out of the standby portion by rotating in the normal direction; and a control portion overlapping a sheet sequentially conveyed by the first sheet conveying portion by sequentially shifting in a sheet conveying direction with respect to a preceding standby sheet and driving the second and third sheet conveying portions such that the overlapped sheets are conveyed to and are made to stand by at the standby portion, the control portion setting a shift length between a first sheet drawn first into the standby portion and a second sheet succeeding to the first sheet in accordance to a number of sheets overlapped when the sheets are discharged to the sheet stacking portion.

12. The sheet processing apparatus according to claim 11, wherein the control portion controls such that the shift length between the first and second sheets in a case where the number of overlapped sheets discharged to the sheet stacking portion is a predetermined number of sheets, is less than the shift length in a case where the number of overlapped sheets discharged to the sheet stacking portion is less than the predetermined number of sheets.

13. The sheet processing apparatus according to claim 11, wherein the control portion controls such that a shift length between the second sheet and a third sheet succeeding to the second sheet in a case where the number of overlapped sheets discharged to the sheet stacking portion is a predetermined number of sheets, is less than a shift length in a case where the number of overlapped sheets discharged to the sheet stacking portion is less than the predetermined number of sheets.

* * * * *